US011640889B2

(12) United States Patent
Miyake et al.

(10) Patent No.: US 11,640,889 B2
(45) Date of Patent: May 2, 2023

(54) ELECTROMAGNETIC RELAY

(71) Applicant: OMRON Corporation, Kyoto (JP)

(72) Inventors: Ayaka Miyake, Kyoto (JP); Shinya Yamamoto, Kyoto (JP); Daisuke Otsubo, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 69 days.

(21) Appl. No.: 17/496,783

(22) Filed: Oct. 8, 2021

(65) Prior Publication Data

US 2022/0122795 A1 Apr. 21, 2022

(30) Foreign Application Priority Data

Oct. 20, 2020 (JP) ..... JP2020-176214

(51) Int. Cl.

| | |
|---|---|
| ***H01H 50/54*** | (2006.01) |
| ***H01H 50/60*** | (2006.01) |
| ***H01H 50/02*** | (2006.01) |
| ***H01H 50/64*** | (2006.01) |
| ***H01H 50/36*** | (2006.01) |
| *H01H 50/58* | (2006.01) |

(52) U.S. Cl.

CPC ..... *H01H 50/60* (2013.01); *H01H 50/02* (2013.01); *H01H 50/36* (2013.01); *H01H 50/64* (2013.01); *H01H 50/58* (2013.01)

(58) Field of Classification Search

CPC ..... H01H 50/60; H01H 50/02; H01H 50/36; H01H 50/64; H01H 50/58; H01H 50/026; H01H 50/045; H01H 50/54; H01H 50/20; H01H 50/546; H01H 50/641; H01H 50/648; H01H 51/065; H01H 50/14; H01H 50/18

USPC ..... 335/2

See application file for complete search history.

(56) References Cited

U.S. PATENT DOCUMENTS

| | | | | |
|---|---|---|---|---|
| 2008/0030288 | A1* | 2/2008 | Mader | H01H 50/043 335/2 |
| 2015/0123750 | A1* | 5/2015 | Pan | H01H 50/36 116/173 |
| 2016/0233039 | A1 | 8/2016 | Kanematsu et al. | |
| 2019/0066951 | A1 | 2/2019 | Kanematsu et al. | |
| 2022/0122795 | A1* | 4/2022 | Miyake | H01H 50/02 |
| 2022/0293373 | A1* | 9/2022 | Nishida | H01H 50/04 |

(Continued)

FOREIGN PATENT DOCUMENTS

JP 2017-204480 A 11/2017

*Primary Examiner* — Mohamad A Musleh
*Assistant Examiner* — Lisa N Homza
(74) *Attorney, Agent, or Firm* — Shinjyu Global IP

(57) ABSTRACT

An electromagnetic relay includes a moving member, a yoke, a guide member, and a movable iron core. The yoke includes a plate portion and a yoke hole. The guide member is disposed in the yoke hole. The movable iron core is connected to the moving member. The movable iron core includes a tubular portion. The tubular portion includes a first end surface and a second end surface. The tubular portion is disposed in the guide member. The plate portion includes a first surface and a second surface. In a case where the moving member is located at the closed position, the first end surface is located within a range from a first position to a second position. The first position is a position corresponding to the first surface. The second position is located at a center of the first surface and the second surface.

10 Claims, 15 Drawing Sheets

(56) References Cited

U.S. PATENT DOCUMENTS

| | | | | |
|---|---|---|---|---|
| 2022/0293375 | A1* | 9/2022 | Kawaguchi | H01H 50/54 |
| 2022/0293378 | A1* | 9/2022 | Tsukada | H01H 9/443 |
| 2022/0293381 | A1* | 9/2022 | Nishida | H01H 50/54 |

* cited by examiner

ELECTROMAGNETIC RELAY

CROSS-REFERENCE TO RELATED APPLICATION

This application claims priority to Japanese Patent Application No. 2020-176214, filed Oct. 20, 2020. The contents of that application are incorporated by reference herein in their entirety.

FIELD

The present invention relates to an electromagnetic relay.

BACKGROUND

Some electromagnetic relays have a movable contact piece held by a holder (see Japanese Patent Application Laid-Open No. 2017-204480). The holder is connected to a movable iron core via a shaft. An electromagnetic force acts on the movable iron core due to a magnetic field generated from a coil, and the movable iron core moves due to the electromagnetic force. The movable contact piece moves together with the shaft and the holder in accordance with the movement of the movable iron core. As a result, the contacts are opened and closed.

SUMMARY

Generally, the shaft described above is made of metal, and it is difficult to provide a large insulation distance between the shaft and the movable contact piece. An object of the present disclosure is to provide a large insulation distance from a movable contact piece in an electromagnetic relay.

An electromagnetic relay according to one aspect of the present disclosure includes a first fixed terminal, a first fixed contact, a second fixed terminal, a second fixed contact, a first movable contact piece, a first movable contact, a second movable contact, a moving member, a housing, a spool, a coil, a yoke, a guide member, and a movable iron core. The first fixed contact is connected to the first fixed terminal. The second fixed contact is connected to the second fixed terminal. The first movable contact is connected to the first movable contact piece and faces the first fixed contact. The second movable contact is connected to the first movable contact piece and faces the second fixed contact.

The moving member holds the first movable contact piece. The moving member is configured to move in a moving direction between a closed position and an open position. In a case where the moving member is located at the closed position, the first movable contact and the second movable contact come into contact with the first fixed contact and the second fixed contact respectively. In a case where the moving member is located at the open position, the first movable contact and the second movable contact are separated from the first fixed contact and the second fixed contact respectively. The moving member is made of a resin having electrical insulation. The housing slidably supports the moving member in a support direction perpendicular to the moving direction.

The spool includes a spool hole extending in the moving direction. The coil is wound around the spool. The yoke includes a pipe portion, a plate portion, and a yoke hole. The pipe portion is disposed in the spool hole. The plate portion extends from the pipe portion in a lateral direction and the support direction. The lateral direction is perpendicular to the support direction and the moving direction. The yoke hole extends in the moving direction through the pipe portion and the plate portion. The guide member is disposed in the yoke hole. The guide member includes a first guide portion, a second guide portion, and a step. The first guide portion is disposed in the yoke hole. The second guide portion has an inner diameter larger than an inner diameter of the first guide portion. The step is disposed between the first guide portion and the second guide portion.

The movable iron core is connected to the moving member. The movable iron core is configured to move in the moving direction by a magnetic force generated by the coil. The movable iron core includes a tubular portion and a shaft portion. The tubular portion includes a first end surface and a second end surface in the moving direction. The tubular portion is disposed in the guide member. The shaft portion projects from the first end surface toward the moving member. The plate portion includes a first surface and a second surface. The first surface faces the moving member. The second surface is located opposite the first surface and faces the spool. In a case where the moving member is located at the closed position, a part of the tubular portion is located in the second guide portion. In a case where the moving member is located at the closed position, the first end surface is located within a range from a first position to a second position. The first position is a position corresponding to the first surface. The second position is located at a center of the first surface and the second surface in the moving direction.

In the electromagnetic relay according to the present aspect, the first movable contact piece is connected to the movable iron core via the moving member. The moving member is made of a resin having electrical insulation. Therefore, a large insulation distance between the first movable contact piece and the movable iron core is provided. Further, in a case where the moving member is located at the closed position, the first end surface of the movable iron core is located within the range from the first position to the second position. Therefore, an inclination of the movable iron core is suppressed. As a result, the behavior of the first movable contact piece is stabilized, and thereby the operation of the electromagnetic relay is stabilized. In addition, the magnetic efficiency between the yoke and the movable iron core is improved.

The first end surface may be located in the first guide portion in a case where the moving member is located in the closed position. In this case, the inclination of the movable iron core is further suppressed.

The first end surface may be located outside the guide member in a case where the moving member is located at the open position. The second end surface may be located within a range from a third position to a fourth position in a case where the moving member is located at the open position. The third position may be a position corresponding to the step. The fourth position may be a position that is apart from the third position by a predetermined distance in the moving direction in the second guide portion. The predetermined distance may be one-third of a length of the second guide portion in the moving direction. In this case, the inclination of the movable iron core is further suppressed.

The first guide portion may protrude from the first surface toward the moving member. In this case, the inclination of the movable iron core is further suppressed. The guide member may be made of a non-magnetic material. In this case, the magnetic efficiency between the yoke and the movable iron core is further improved.

The moving member may include a support portion, a connecting portion, and a link portion. The support portion may support the first movable contact piece. The connecting portion may be connected to the movable iron core. The link portion may extend in the moving direction. The link portion may link the support portion and the connecting portion. In this case, a large insulation distance between the first movable contact piece and the movable iron core is provided.

The support portion may extend in the support direction. The link portion may be connected to a central portion of the support portion in the support direction. In this case, the inclination of the moving member is suppressed. As a result, the behavior of the first movable contact piece is stabilized, and thereby the operation of the electromagnetic relay is stabilized.

The electromagnetic relay may further include a third fixed contact, a fourth fixed contact, a second movable contact piece, a third movable contact, and a fourth movable contact. The third fixed contact may be connected to the first fixed terminal. The fourth fixed contact may be connected to the second fixed terminal. The third movable contact may be connected to the second movable contact piece. The third movable contact may face the third fixed contact. The fourth movable contact may be connected to the second movable contact piece. The fourth movable contact may face the fourth fixed contact. The support portion may support the second movable contact piece. The link portion may be connected to the support portion at a position between the first movable contact piece and the second movable contact piece in the support direction. In this case, the inclination of the moving member is suppressed. As a result, the behavior of the first movable contact piece is stabilized, and thereby the operation of the electromagnetic relay is stabilized.

The support portion may include a first slider. The first slider may protrude in the support direction. The first slider may be slidable with respect to the housing. In this case, the moving member can be moved stably.

The support portion may further include a second slider. The second slider may protrude in a direction opposite to the support direction. The second slider may be slidable with respect to the housing. In this case, the moving member can be stably moved regardless of the arrangement direction of the electromagnetic relay.

DETAILED DESCRIPTION

Figure 1:
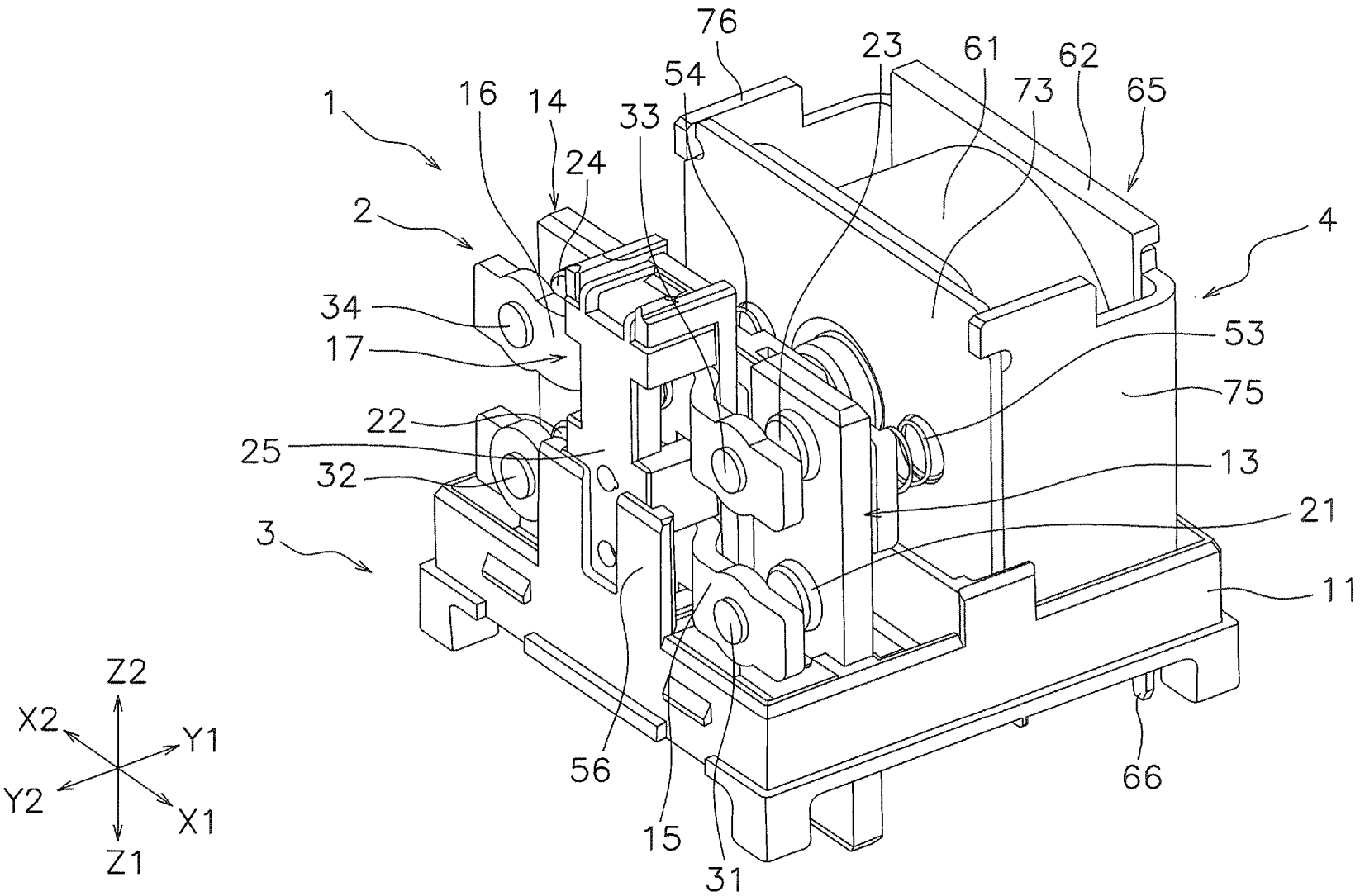
FIG. 1 is a perspective view of an electromagnetic relay according to an embodiment.
Figure 2:
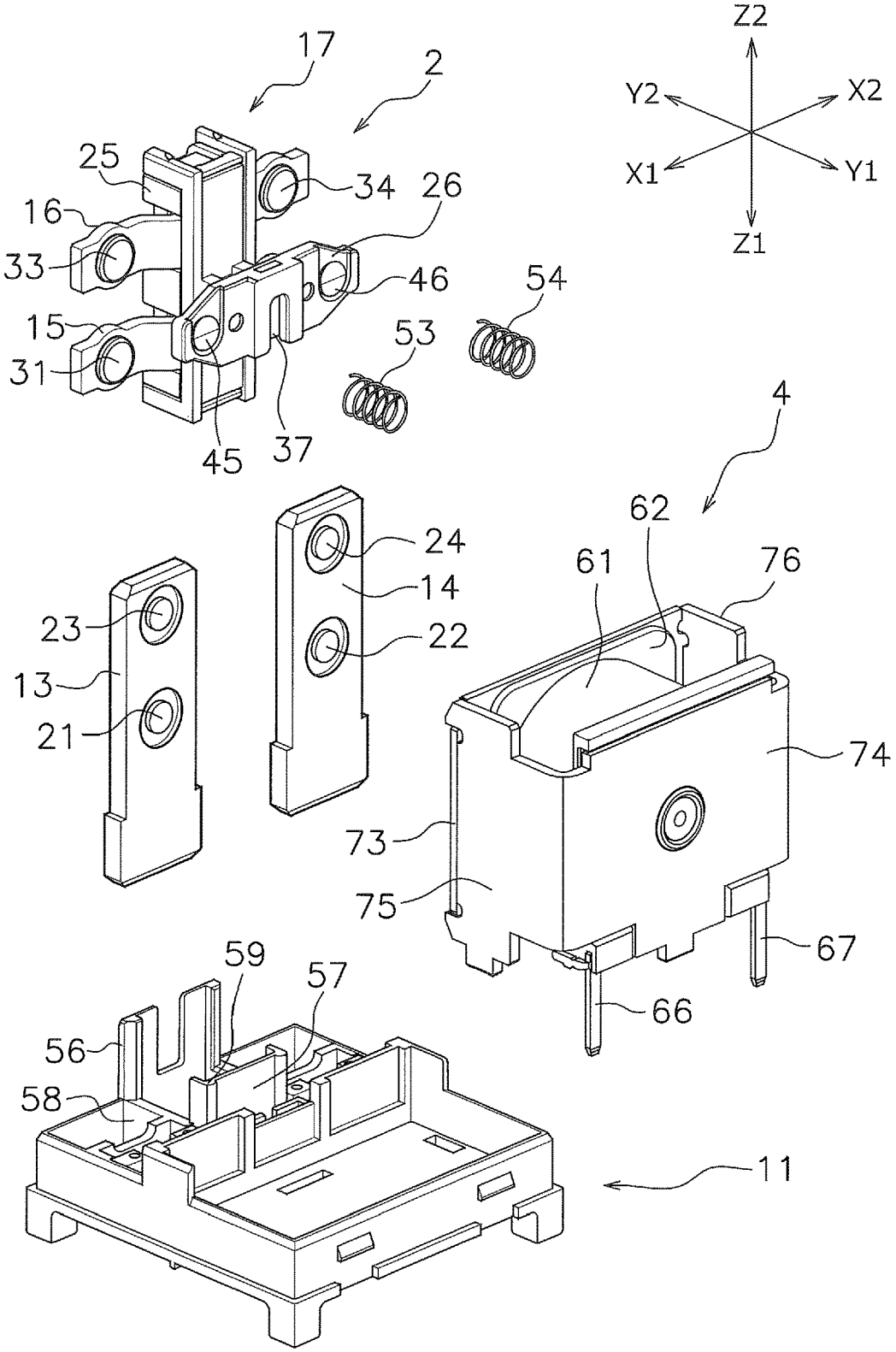
FIG. 2 is an exploded perspective view of the electromagnetic relay.
Figure 3:
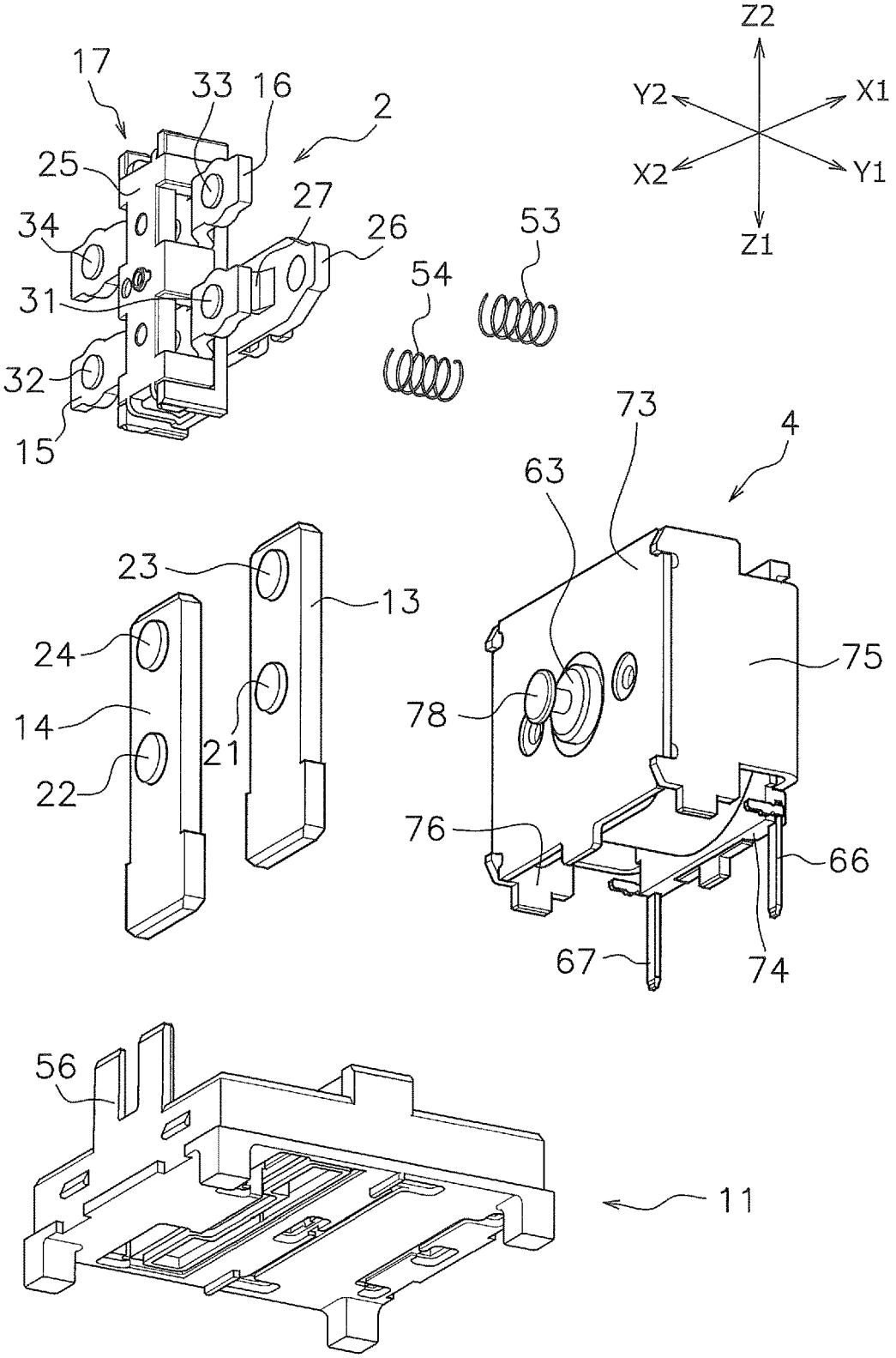
FIG. 3 is an exploded perspective view of the electromagnetic relay.
Figure 4:
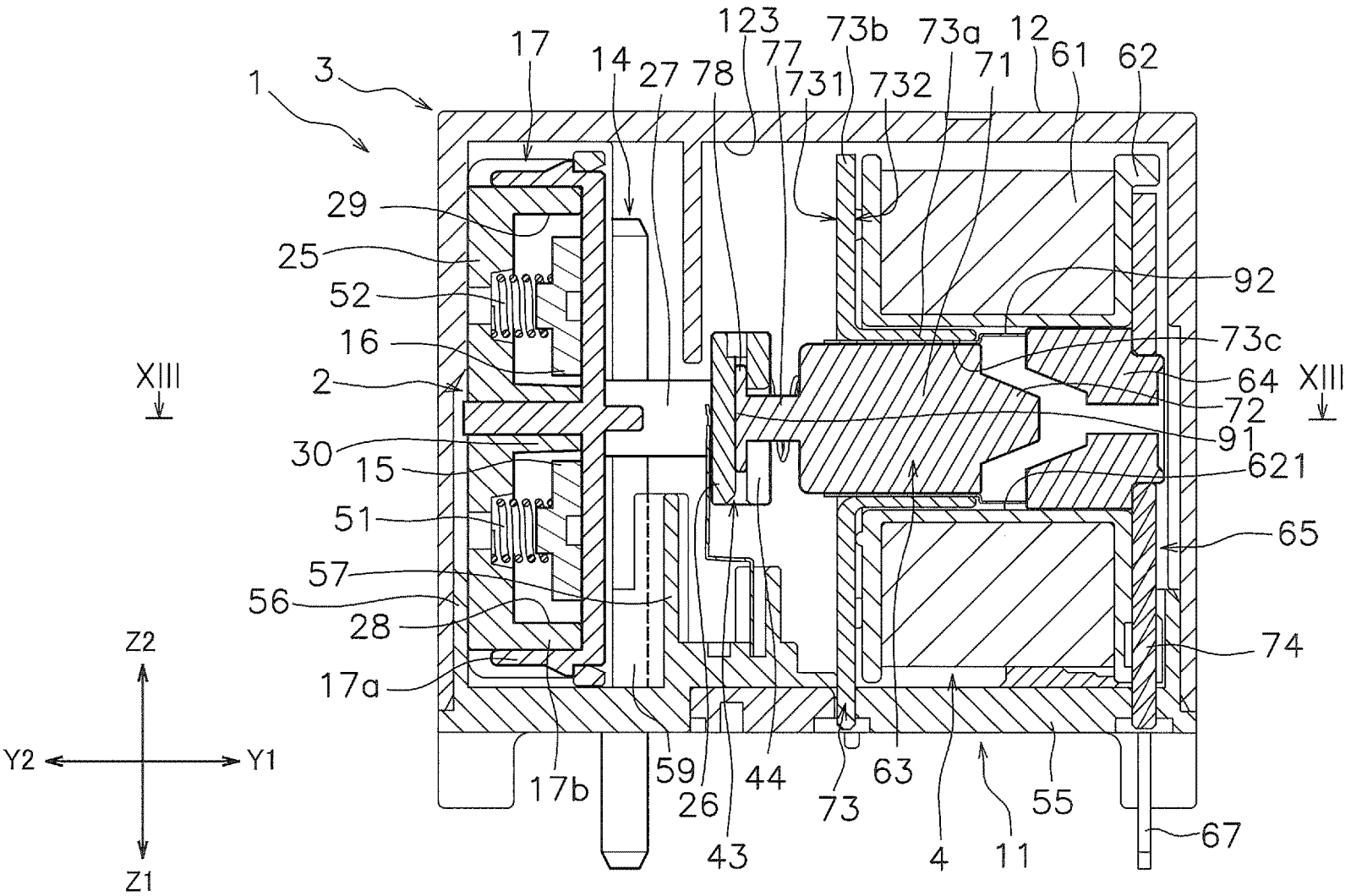
FIG. 4 is a vertical cross-sectional view of the electromagnetic relay.
Figure 5:
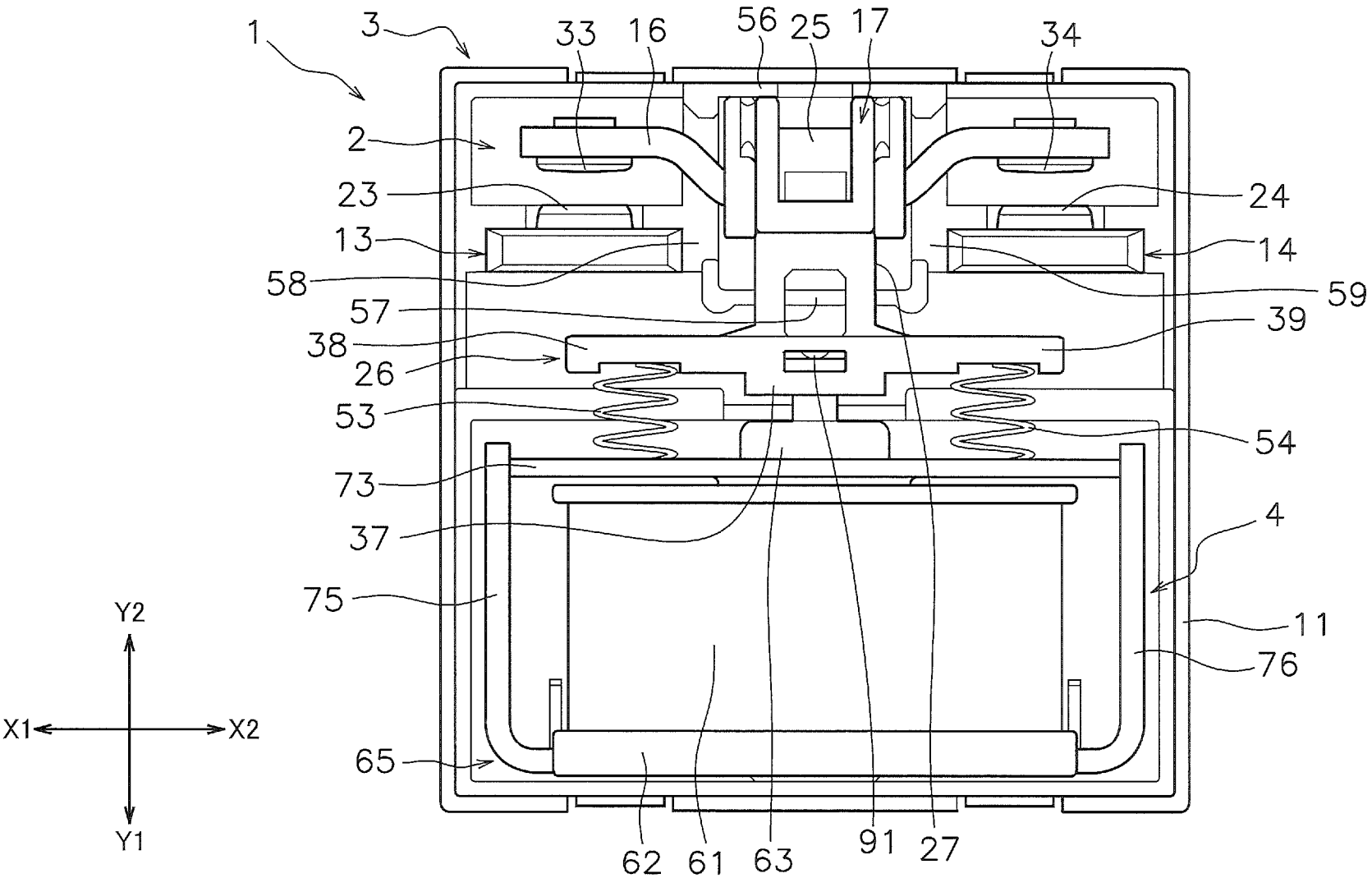
FIG. 5 is a top view of the electromagnetic relay when a moving member is in an open position.
Figure 6:
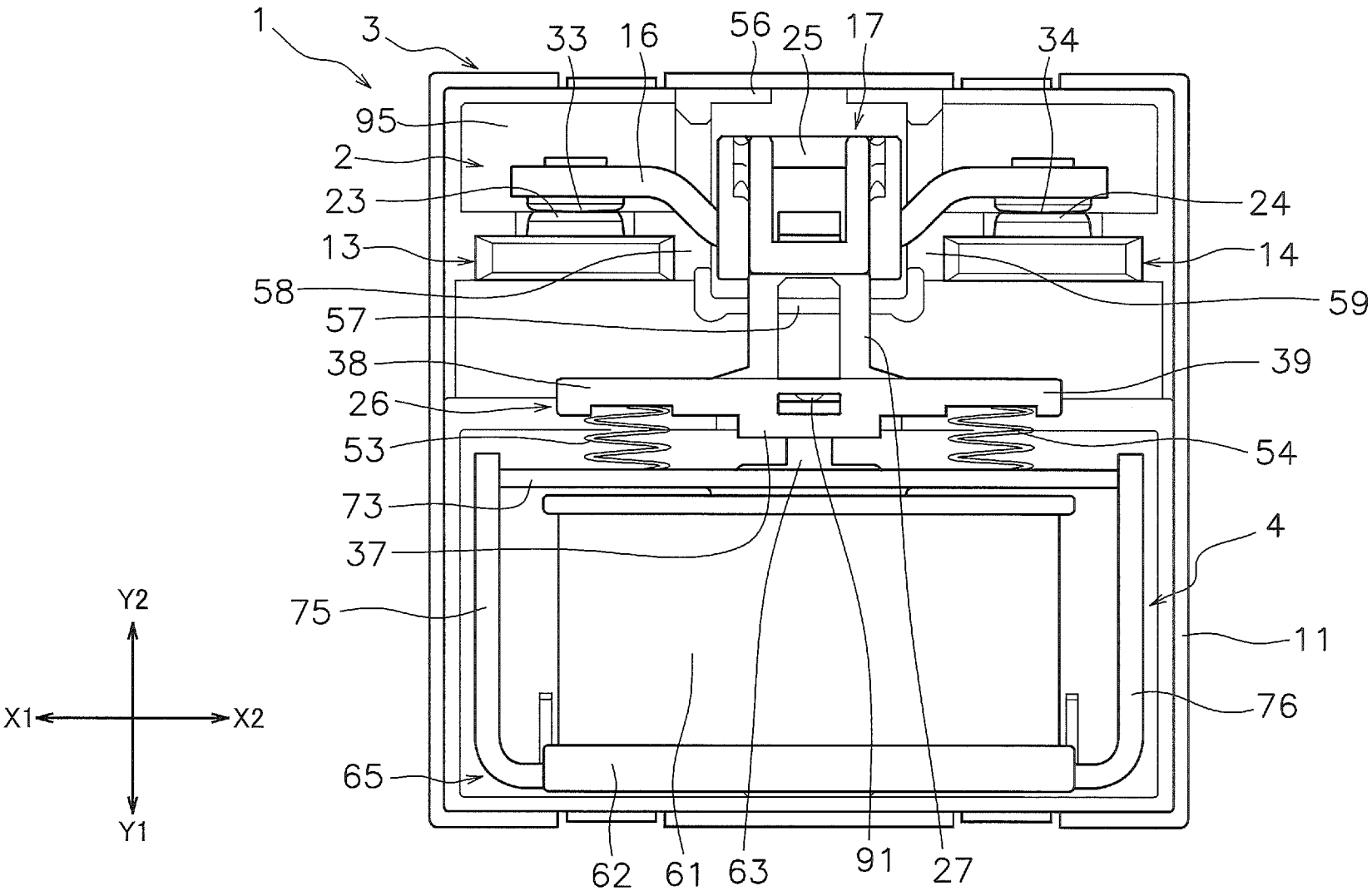
FIG. 6 is a top view of the electromagnetic relay when the moving member is in a closed position.

Hereinafter, an electromagnetic relay 1 according to an embodiment will be described with reference to the drawings. FIG. 1 is a perspective view of the electromagnetic relay 1 according to the embodiment. FIGS. 2 and 3 are exploded perspective views of the electromagnetic relay 1. FIG. 4 is a vertical cross-sectional view of the electromagnetic relay 1. FIGS. 5 and 6 are top views of the electromagnetic relay 1.

The electromagnetic relay 1 includes a contact block 2, a housing 3, a coil block 4, a first fixed terminal 13, and a second fixed terminal 14. The contact block 2 and the coil block 4 are disposed in the housing 3. The housing 3 includes a base 11 and a case 12. The base 11 and the case 12 are made of, for example, resin. In FIG. 1, the case 12 is omitted. The base 11 supports the first fixed terminal 13, the second fixed terminal 14, the contact block 2, and the coil block 4.

In the present embodiment, a moving direction (Y1, Y2), a support direction (Z1, Z2), and a lateral direction (X1, X2) are defined as follows. The moving direction (Y1, Y2) is a direction in which the contact block 2 and the coil block 4 are aligned with each other. The moving direction (Y1, Y2) includes a first moving direction (Y1) and a second moving direction (Y2). The first moving direction (Y1) is a direction from the contact block 2 toward the coil block 4. The second moving direction (Y2) is a direction opposite to the first moving direction (Y1). The second moving direction (Y2) is a direction from the coil block 4 toward the contact block 2.

The support direction (Z1, Z2) is a direction perpendicular to the moving direction (Y1, Y2). The support direction (Z1, Z2) is a direction in which the base 11 and the contact block 2 are aligned with each other. The support direction (Z1, Z2) includes a first support direction (Z1) and a second support direction (Z2). The first support direction (Z1) is a direction from the contact block 2 toward the base 11. The second support direction (Z2) is a direction opposite to the first support direction (Z1). The second support direction (Z2) is a direction from the base 11 toward the contact block 2. Alternatively, the support direction (Z1, Z2) may be a direction in which the base 11 and the coil block 4 are aligned with each other.

The lateral direction (X1, X2) is a direction perpendicular to the moving direction (Y1, Y2) and the support direction (Z1, Z2). The lateral direction (X1, X2) includes a first lateral direction (X1) and a second lateral direction (X2). The second lateral direction (X2) is a direction opposite to the first lateral direction (X1).

The first fixed terminal 13 and the second fixed terminal 14 are made of a conductive material such as copper. The first fixed terminal 13 and the second fixed terminal 14 extend in the support direction (Z1, Z2), respectively. The first fixed terminal 13 and the second fixed terminal 14 are disposed apart from each other in the lateral direction (X1, X2). The first fixed terminal 13 is fixed to the base 11. A tip of the first fixed terminal 13 projects outward from the base 11. The second fixed terminal 14 is fixed to the base 11. A tip of the second fixed terminal 14 projects outward from the base 11.

The first fixed contact 21 and the third fixed contact 23 are connected to the first fixed terminal 13. The first fixed contact 21 and the third fixed contact 23 are disposed apart from each other in the support direction (Z1, Z2) on the first fixed terminal 13. The second fixed contact 22 and the fourth fixed contact 24 are connected to the second fixed terminal 14. The second fixed contact 22 and the fourth fixed contact 24 are disposed apart from each other in the support direction (Z1, Z2) on the second fixed terminal 14. The first to fourth fixed contacts 21 to 24 are made of a conductive material such as silver or copper.

The contact block 2 includes a first movable contact piece 15, a second movable contact piece 16, and a moving member 17. The first movable contact piece 15 and the second movable contact piece 16 extend in the lateral direction (X1, X2). The first movable contact piece 15 and the second movable contact piece 16 are separate bodies from each other. The first movable contact piece 15 and the second movable contact piece 16 are disposed apart from each other in the support direction (Z1, Z2). The first movable contact piece 15 is disposed between the second movable contact piece 16 and the base 11 in the support direction (Z1, Z2). The first movable contact piece 15 and the second movable contact piece 16 are made of a conductive material such as copper.

The first movable contact 31 and the second movable contact 32 are connected to the first movable contact piece 15. The first movable contact 31 and the second movable contact 32 are disposed apart from each other in the lateral direction (X1, X2). The first movable contact 31 is disposed to face the first fixed contact 21. The second movable contact 32 is disposed to face the second fixed contact 22.

The third movable contact 33 and the fourth movable contact 34 are connected to the second movable contact piece 16. The third movable contact 33 and the fourth movable contact 34 are disposed apart from each other in the lateral direction (X1, X2). The third movable contact 33 is disposed to face the third fixed contact 23. The fourth movable contact 34 is disposed to face the fourth fixed contact 24. The first to fourth movable contacts 31 to 34 are made of a conductive material such as silver or copper.

The moving member 17 holds the first movable contact piece 15 and the second movable contact piece 16. The moving member 17 is made of resin having electrical insulation. The moving member 17 is made of nylon, for example. However, the moving member 17 may be made of a material other than nylon. The moving member 17 is supported by the housing 3 in the support direction (Z1, Z2). The moving member 17 is slidable in the moving direction (Y1, Y2) with respect to the housing 3. The moving member 17 is configured to move between a closed position and an open position. In FIG. 5, the moving member 17 is located at the open position. When the moving member 17 is located at the open position, the movable contacts 31 to 34 are separated from the fixed contacts 21 to 24, respectively. In FIG. 6, the moving member 17 is located at the closed position. When the moving member 17 is located in the closed position, the movable contacts 31 to 34 contact the fixed contacts 21 to 24, respectively.

The coil block 4 moves the first movable contact piece 15 and the second movable contact piece 16 by an electromagnetic force. The coil block 4 moves the first movable contact piece 15 and the second movable contact piece 16 in the first moving direction (Y1) and the second moving direction (Y2). The first moving direction (Y1) is a direction in which the movable contacts 31 to 34 contact the fixed contact 21 to 24 in the moving direction (Y1, Y2). The second moving direction (Y2) is a direction in which the movable contacts 31 to 34 are separated from the fixed contacts 21 to 24 in the moving direction (Y1, Y2). The coil block 4 includes a coil 61, a spool 62, a movable iron core 63, a fixed iron core 64, and a yoke 65.

The coil 61 is wound around the spool 62. An axis of the coil 61 extends in the moving direction (Y1, Y2). The coil 61 is connected to the coil terminals 66 and 67. As illustrated in FIGS. 2 and 3, the coil terminals 66 and 67 project from the coil block 4 in the first support direction (Z1). The coil terminals 66 and 67 project outward from the base 11.

As illustrated in FIG. 4, the spool 62 includes a spool hole 621 extending in the moving direction (Y1, Y2). At least a part of the movable iron core 63 is disposed in the spool hole 621 of the spool 62. The movable iron core 63 is configured to move in the first moving direction (Y1) and the second moving direction (Y2). The fixed iron core 64 is disposed in the spool hole 621 of the spool 62. The fixed iron core 64 is disposed to face the movable iron core 63 in the moving direction (Y1, Y2). The coil 61 generates an electromagnetic force that moves the movable iron core 63 in the first moving direction (Y1) by being energized.

The movable iron core 63 is connected to the moving member 17. The first movable contact piece 15 and the movable iron core 63 are electrically insulated by the moving member 17. The second movable contact piece 16 and the movable iron core 63 are electrically insulated by the moving member 17. The movable iron core 63 moves integrally with the moving member 17 in the moving direction (Y1, Y2). The movable iron core 63 moves in the first moving direction (Y1) according to the magnetic force generated from the coil 61. With the movement of the movable iron core 63, the moving member 17 moves to the closed position. As the moving member 17 moves, the first movable contact piece 15 and the second movable contact piece 16 move in the first moving direction (Y1) or the second moving direction (Y2).

The yoke 65 is disposed so as to surround the coil 61. The yoke 65 is disposed on a magnetic circuit generated by the coil 61. The yoke 65 includes a first yoke 73, a second yoke 74, a third yoke 75, and a fourth yoke 76. The first yoke 73 includes a pipe portion 73*a*, a plate portion 73*b*, and a yoke hole 73*c*. The pipe portion 73*a* is disposed in the spool hole 621. The pipe portion 73*a* has a circular tubular shape.

The plate portion 73*b* extends from the pipe portion 73*a* in the lateral direction (X1, X2) and the support direction (Z1, Z2). The plate portion 73*b* faces the spool 62 in the moving direction (Y1, Y2). The plate portion 73*b* faces the moving member 17 in the moving direction (Y1, Y2). The plate portion 73*b* includes a first surface 731 and a second surface 732. The first surface 731 faces the moving member 17. The second surface 732 is located opposite to the first surface 731. The second surface 732 faces the spool 62. The yoke hole 73*c* extends in the moving direction (Y1, Y2). The yoke hole 73*c* extends through the pipe portion 73*a* and the plate portion 73*b*. The movable iron core 63 is disposed in the yoke hole 73*c*.

The second yoke 74 extends in the lateral direction (X1, X2) and the support direction (Z1, Z2). The second yoke 74 faces the coil 61 in the moving direction (Y1, Y2). The coil 61 is located between the plate portion 73*b* of the first yoke 73 and the second yoke 74 in the moving direction (Y1, Y2). The second yoke 74 is connected to the fixed iron core 64.

The third yoke 75 and the fourth yoke 76 extend in the moving direction (Y1, Y2) and the support direction (Z1, Z2). The third yoke 75 and the fourth yoke 76 face the coil 61 in the lateral direction (X1, X2). The coil 61 is located between the third yoke 75 and the fourth yoke 76 in the lateral direction (X1, X2).

Figure 7:
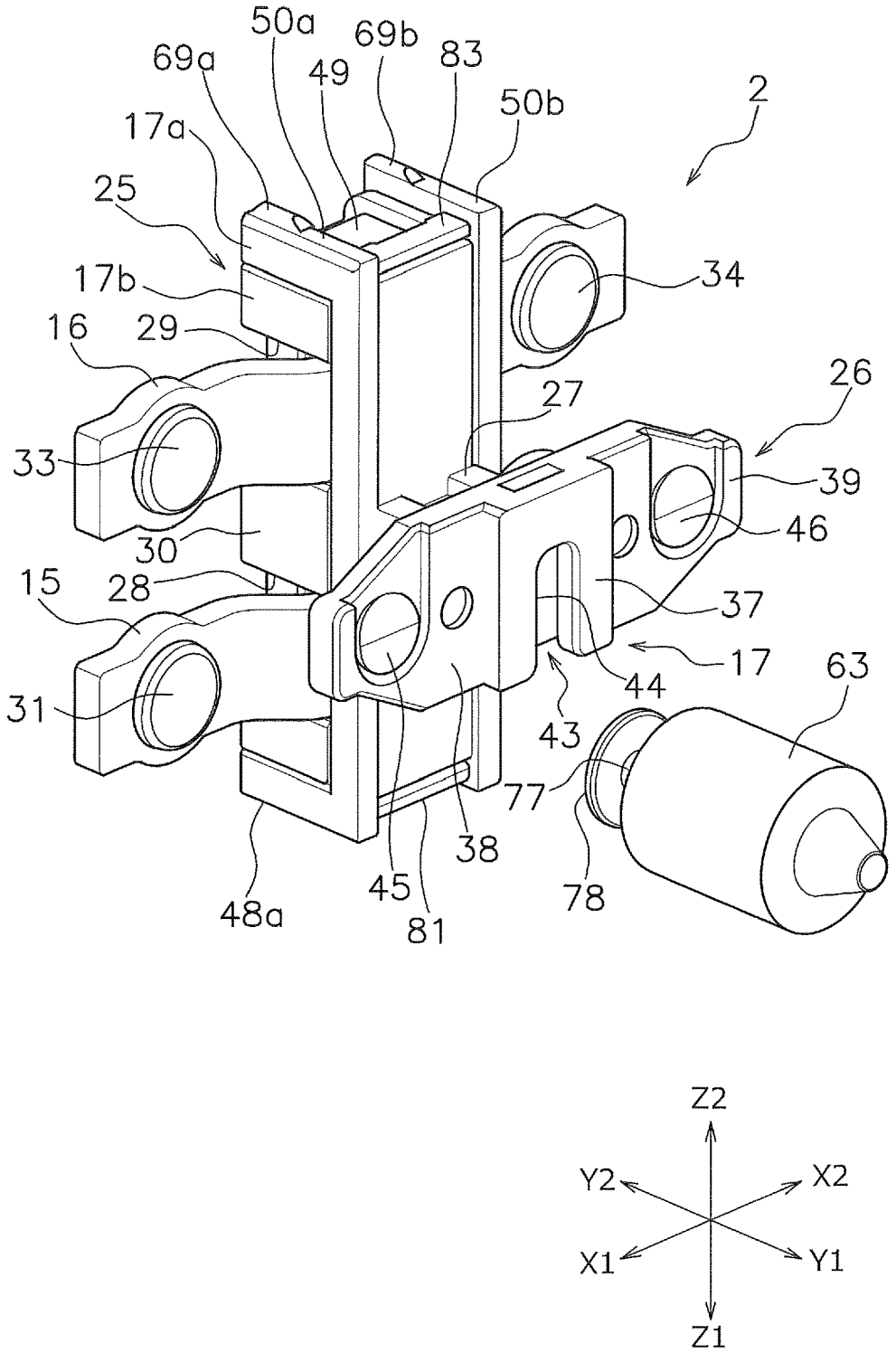
FIG. 7 is a perspective view of the moving member and its surroundings.

FIG. 7 is a perspective view of the moving member 17 and its surroundings. The moving member 17 includes a support portion 25, a connecting portion 26, and a link portion 27. The support portion 25 supports the first movable contact piece 15 and the second movable contact piece 16. The connecting portion 26 is connected to the movable iron core 63. The link portion 27 is located between the support portion 25 and the connecting portion 26. The link portion 27 connects the support portion 25 and the connecting portion 26. The link portion 27 is connected to a central portion of the support portion 25 in the support direction (Z1, Z2). The link portion 27 is connected to the support portion 25 at a position between the first movable contact piece 15 and the second movable contact piece 16 in the support direction (Z1 and Z2). The link portion 27 extends in the moving direction (Y1, Y2).

The support portion 25 extends in the support direction (Z1, Z2). The support portion 25 extends from the first movable contact piece 15 toward the base 11 in the first support direction (Z1). As illustrated in FIG. 4, the support portion 25 extends from the second movable contact piece 16 toward a top surface 123 of the case 12 in the second support direction (Z2). The support portion 25 includes a first support hole 28, a second support hole 29, and a partition wall 30. The first movable contact piece 15 is disposed in the first support hole 28. The first movable contact piece 15 is supported by the support portion 25 between the first movable contact 31 and the second movable contact 32. The first movable contact piece 15 extends from the support portion 25 in the first lateral direction (X1) and the second lateral direction (X2).

The second movable contact piece 16 is disposed in the second support hole 29. The second movable contact piece 16 is supported by the support portion 25 between the third movable contact 33 and the fourth movable contact 34. The second movable contact piece 16 extends from the support portion 25 in the first lateral direction (X1) and the second lateral direction (X2). The partition wall 30 partitions the first support hole 28 and the second support hole 29. The partition wall 30 is disposed between the first movable contact piece 15 and the second movable contact piece 16.

As illustrated in FIGS. 2 and 4, the base 11 includes a bottom surface 55, a first wall 56, a second wall 57, a third wall 58, and a fourth wall 59. The bottom surface 55 supports the contact block 2 and the coil block 4 in the support direction (Z1, Z2). The bottom surface 55 is located in the first support direction (Z1) with respect to the contact block 2 and the coil block 4. The first wall 56, the second wall 57, the third wall 58, and the fourth wall 59 extend from the bottom surface 55 in the second support direction (Z2).

The first wall 56 and the second wall 57 are disposed apart from each other in the moving direction (Y1, Y2). The first wall 56 and the second wall 57 face the support portion 25 of the moving member 17 in the moving direction (Y1, Y2). The support portion 25 is located between the first wall 56 and the second wall 57 in the moving direction (Y1, Y2). The first wall 56 and the second wall 57 extend in the lateral direction (X1, X2). The third wall 58 and the fourth wall 59 face the support portion 25 in the lateral direction (X1, X2). The support portion 25 is located between the first wall 56 and the second wall 57 in the lateral direction (X1, X2). The third wall 58 and the fourth wall 59 extend in the moving direction (Y1, Y2).

The moving member 17 includes a first member 17*a* and a second member 17*b*. The first member 17*a* and the second member 17*b* are separate bodies from each other. The second member 17*b* is connected to the first member 17*a* by snap fitting. The first support hole 28 and the second support hole 29 are provided between the first member 17*a* and the second member 17*b*. The first movable contact piece 15 and the second movable contact piece 16 are held between the first member 17*a* and the second member 17*b* in the moving direction (Y1, Y2). The first member 17*a* is connected to the link portion 27. The first member 17*a* is integrally formed with the link portion 27 and the connecting portion 26.

Figure 8:
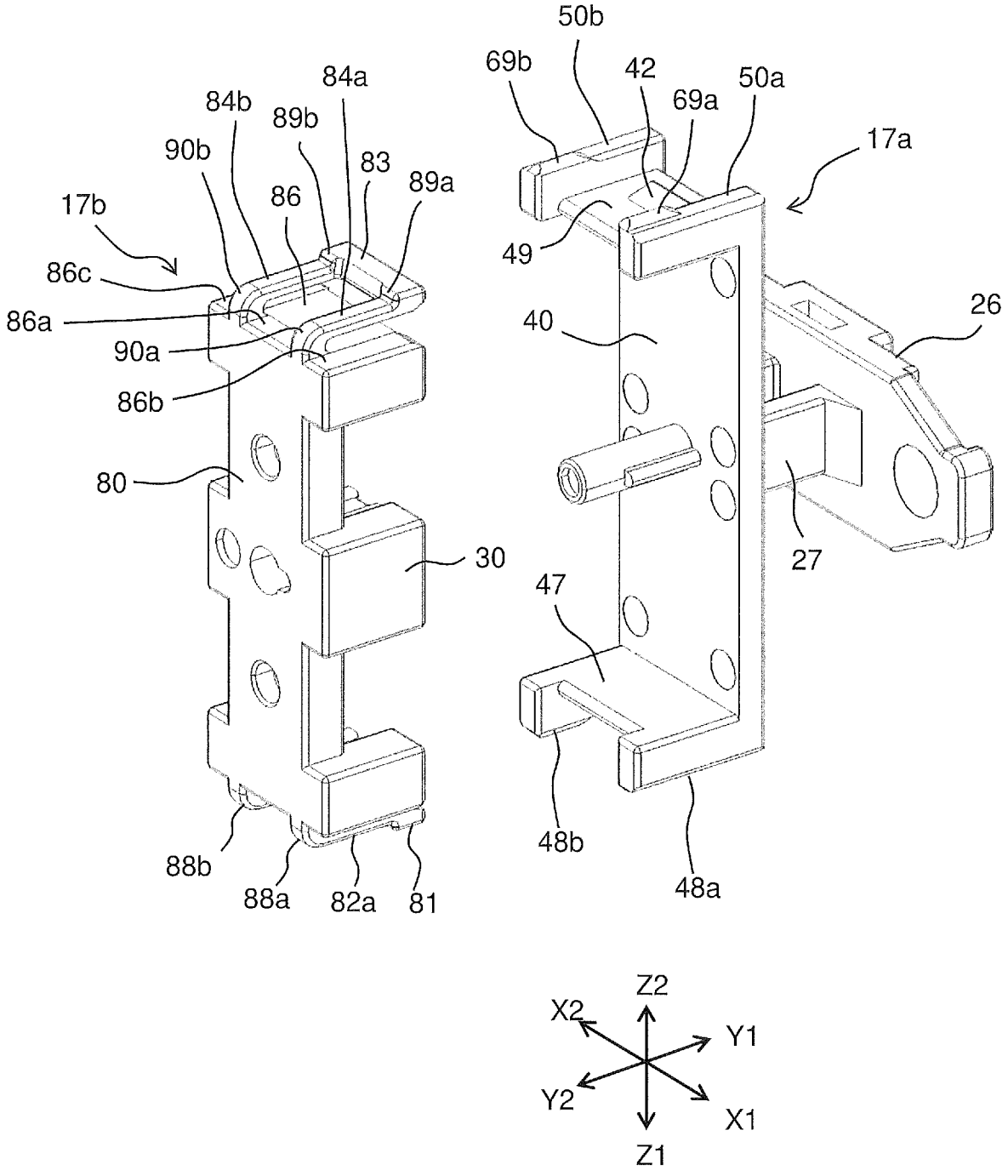
FIG. 8 is an exploded perspective view of the moving member.
Figure 9:
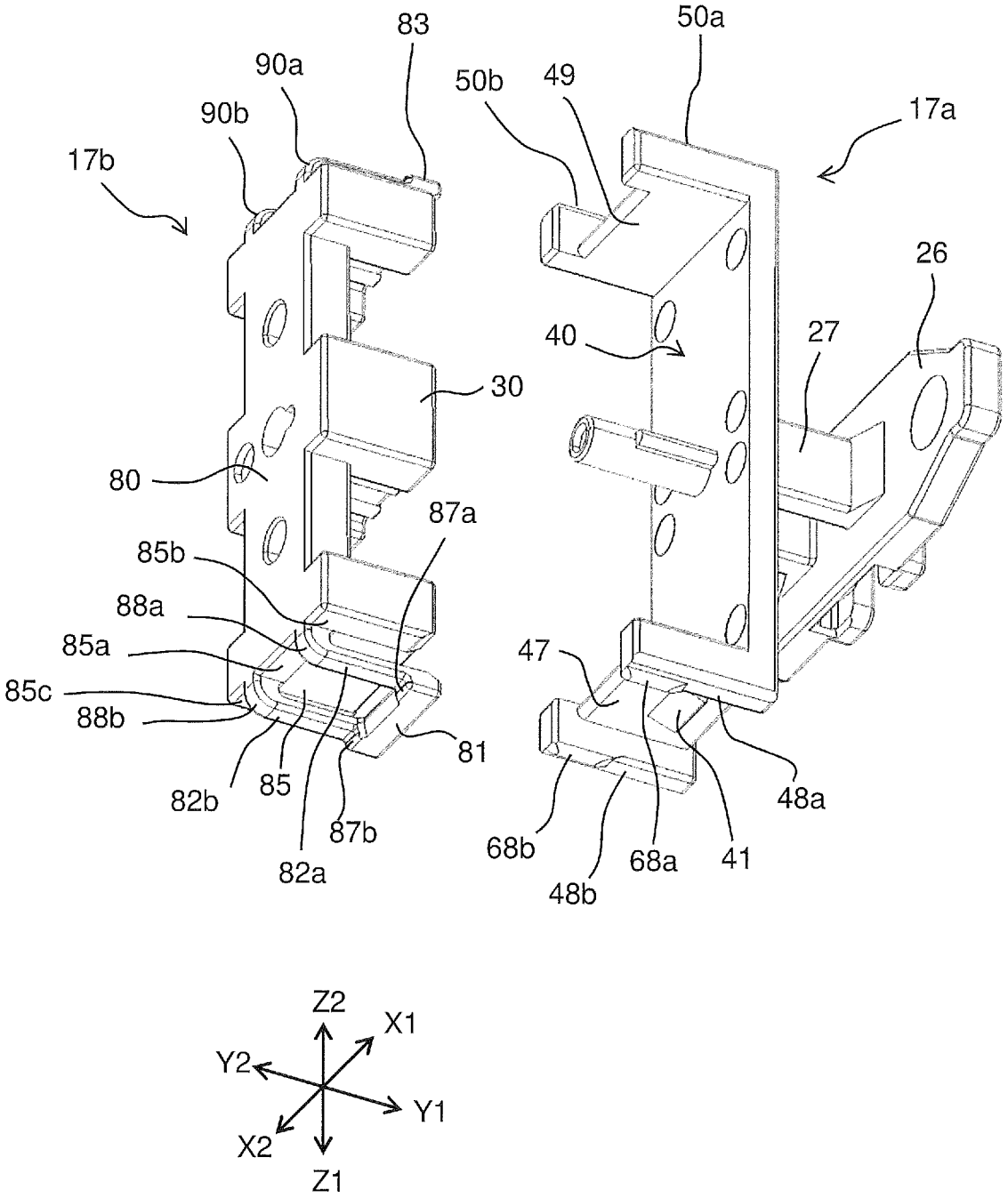
FIG. 9 is an exploded perspective view of the moving member.

FIGS. 8 and 9 are exploded perspective views of the moving member 17. As illustrated in FIGS. 8 and 9, the first member 17*a* includes a first main body 40, a first protrusion 41, and a second protrusion 42. The first main body 40 holds the first movable contact piece 15. The first main body 40 includes a first plate 47, a pair of first ends 48*a* and 48*b*, a second plate 49, and a pair of second ends 50*a* and 50*b*. The first plate 47 extends in the moving direction (Y1, Y2). The pair of first ends 48*a* and 48*b* are the ends of the first member 17*a* in the first support direction (Z1). The pair of first ends 48*a* and 48*b* are disposed apart from each other in the lateral direction (X1, X2). The pair of first ends 48*a* and 48*b* project from the first plate 47 in the first support direction (Z1). The first protrusion 41 projects from the first plate 47 in the first support direction (Z1).

The second plate 49 extends in the moving direction (Y1, Y2). The pair of second ends 50*a* and 50*b* are the ends of the first member 17*a* in the second support direction (Z2). The pair of second ends 50*a* and 50*b* are disposed apart from each other in the lateral direction (X1, X2). The pair of second ends 50*a* and 50*b* project from the second plate 49 in the second support direction (Z2). The second protrusion 42 projects from the second plate 49 in the second support direction (Z2).

Figure 10:
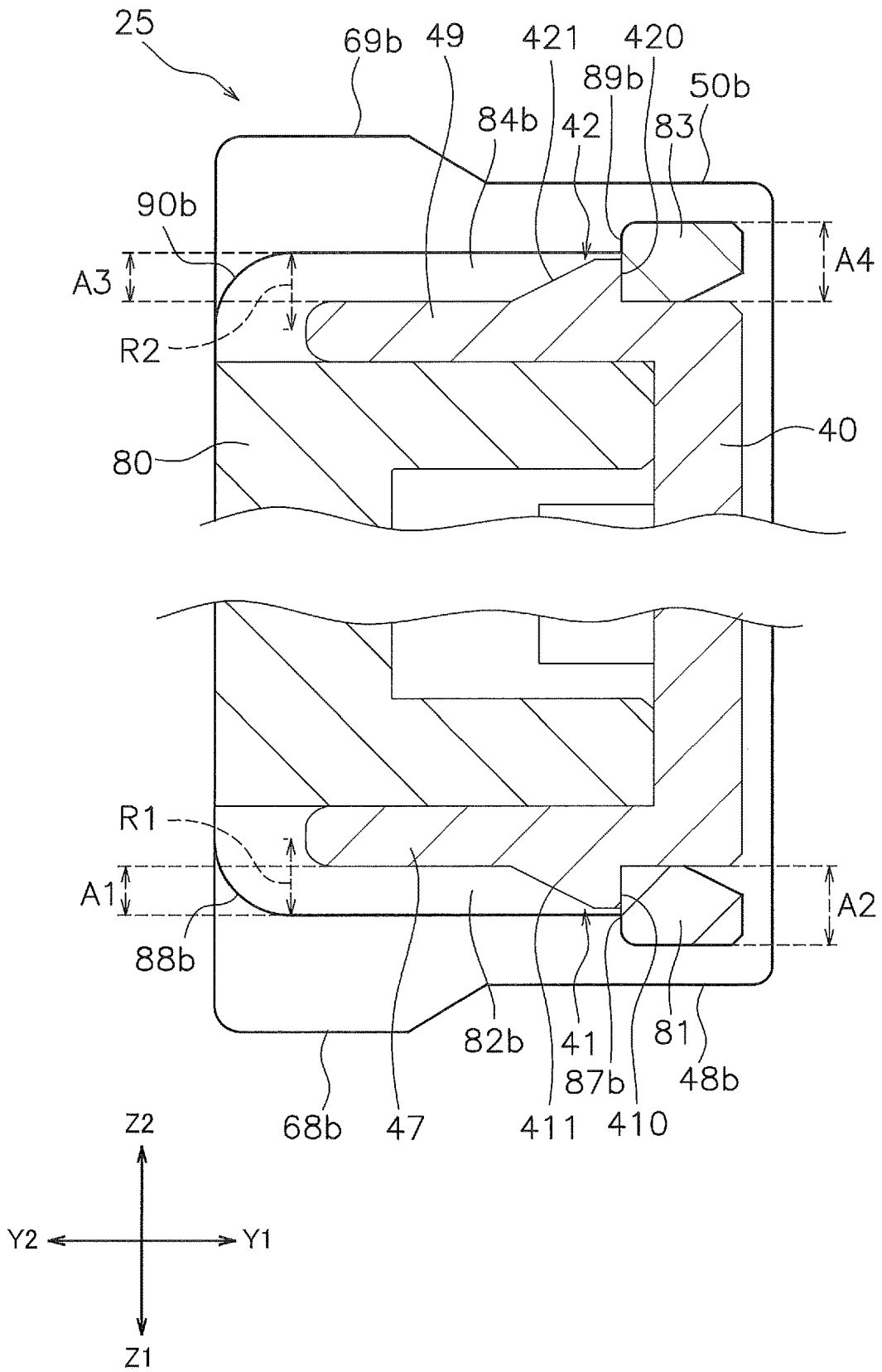
FIG. 10 is a vertical cross-sectional view of the moving member.

FIG. 10 is a vertical cross-sectional view of the moving member 17. As illustrated in FIG. 10, the first protrusion 41 includes a first locking surface 410 and a first tapered surface 411. The first locking surface 410 extends from the first main body 40 in the first support direction (Z1). The first tapered surface 411 is inclined with respect to the first support direction (Z1). The second protrusion 42 includes a second locking surface 420 and a second tapered surface 421. The second locking surface 420 extends from the first main body 40 in the second support direction (Z2). The second tapered surface 421 is inclined with respect to the second support direction (Z2).

The first member 17*a* includes first sliders 68*a* and 68*b* and a pair of second sliders 69*a* and 69*b*. The first sliders 68*a* and 68*b* project from the first ends 48*a* and 48*b* in the first support direction (Z1) and are slidable with respect to the base 11. The first sliders 68*a* and 68*b* extend in the moving direction (Y1, Y2), respectively. The first sliders 68*a* and 68*b* are disposed apart from each other in the lateral direction (X1, X2). The pair of second sliders 69*a* and 69*b* project from the second ends 50*a* and 50*b* in the second support direction (Z2) and are slidable with respect to the case 12. The pair of second sliders 69*a* and 69*b* extend in the moving direction (Y1, Y2), respectively. The pair of second sliders 69*a* and 69*b* are disposed apart from each other in the lateral direction (X1, X2).

Figure 11:
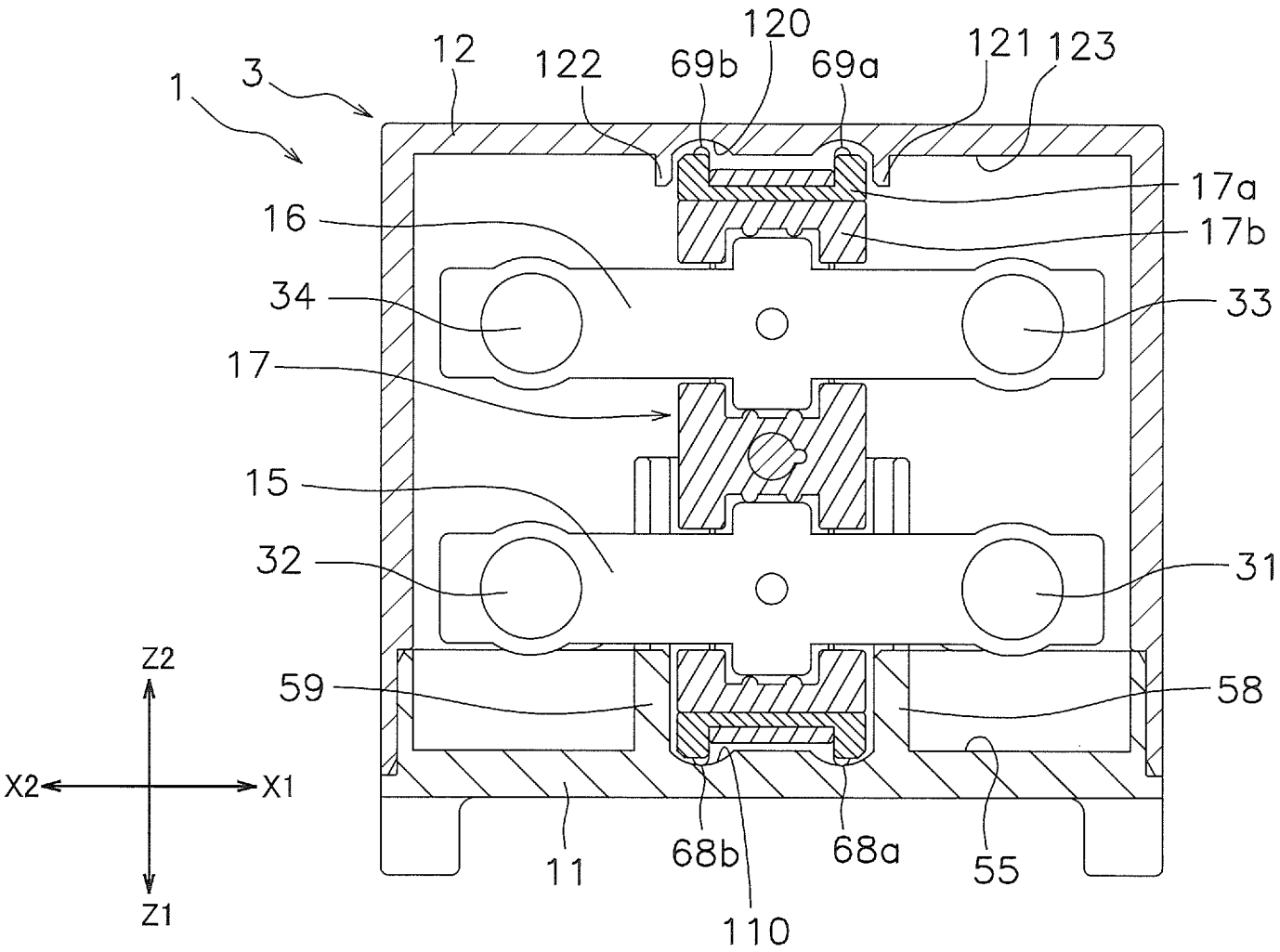
FIG. 11 is a cross-sectional view of the electromagnetic relay as seen from a first moving direction.

FIG. 11 is a cross-sectional view of the electromagnetic relay 1 as seen from the first moving direction (Y1). As illustrated in FIG. 11, the housing 3 includes a first receiving surface 110 and a second receiving surface 120. The first receiving surface 110 is provided on the base 11. The first receiving surface 110 is located between the third wall 58 and the fourth wall 59. The first receiving surface 110 faces the first sliders 68*a* and 68*b*. The first receiving surface 110 has curved and recessed portions facing the first sliders 68*a* and 68*b*. The first sliders 68*a* and 68*b* are slidable on the first receiving surface 110.

The second receiving surface 120 is provided on the case 12. The case 12 includes a first guide wall 121 and a second guide wall 122. The first guide wall 121 and the second guide wall 122 extend from the top surface 123 of the case 12 in the first support direction (Z1). The first guide wall 121 and the second guide wall 122 extend in the moving direction (Y1, Y2). The second receiving surface 120 is located between the first guide wall 121 and the second guide wall 122. The second receiving surface 120 faces the second sliders 69*a* and 69*b*. The second receiving surface 120 has curved and recessed portions facing the second sliders 69*a* and 69*b*. The second sliders 69*a* and 69*b* are slidable on the second receiving surface 120.

As illustrated in FIGS. 8 and 9, the second member 17*b* includes a second main body 80, a first locking portion 81, a pair of first arms 82*a* and 82*b*, a second locking portion 83, and a pair of second arms 84*a* and 84*b*. The second main body 80 holds the first movable contact piece 15. The second main body 80 includes the partition wall 30 described above. The second main body 80 forms the first support hole 28 and the second support hole 29 together with the first main body 40. The second main body 80 includes a first surface 85 and a second surface 86. The first surface 85 is an end surface of the second main body 80 in the first support direction (Z1). The second surface 86 is an end surface of the second main body 80 in the second support direction (Z2).

The first locking portion 81 extends in the lateral direction (X1, X2). The first locking portion 81 is connected to the pair of first arms 82*a* and 82*b*. The pair of first arms 82*a* and 82*b* connect the second main body 80 and the first locking portion 81. The pair of first arms 82*a* and 82*b* are disposed apart from each other in the lateral direction (X1, X2). The first arms 82*a* and 82*b* project from the second main body 80 in the first support direction (Z1). Specifically, the first arms 82*a* and 82*b* project from the first surface 85 in the first support direction (Z1). The first arms 82*a* and 82*b* have a shape bent in the first moving direction (Y1). The first arms 82*a* and 82*b* are connected to the ends of the first locking portion 81 in the lateral direction (X1, X2), respectively. First steps 87*a* and 87*b* are provided between the first locking portion 81 and the first arms 82*a* and 82*b*. The first arms 82*a* and 82*b* include the first corners 88*a* and 88*b*. The first corners 88*a* and 88*b* are rounded. As illustrated in FIG. 9, the first surface 85 includes a surface 85*a* located between the first arms 82*a* and 82*b*, a surface 85*b* located in the first lateral direction (X1) of the first arms 82*a*, and a surface 85*c* located in the second lateral direction (X2) of the first arm 82*b*. The surface 85*a* is located at the same height as the surfaces 85*b* and 85*c* in the support direction (Z1, Z2). As a result, the flexibility of the first arms 82*a* and 82*b* is improved.

The second locking portion 83 extends in the lateral direction (X1, X2). The second locking portion 83 is connected to the pair of second arms 84*a* and 84*b*. The pair of second arms 84*a* and 84*b* connect the second main body 80 and the second locking portion 83. The pair of second arms 84*a* and 84*b* are disposed apart from each other in the lateral direction (X1, X2). The second arms 84*a* and 84*b* project from the second main body 80 in the second support direction (Z2). Specifically, the second arms 84*a* and 84*b* project from the second surface 86 in the second support direction (Z2). The second arms 84*a* and 84*b* have a shape bent in the first moving direction (Y1). The second arms 84*a* and 84*b* are connected to the ends of the second locking portion 83 in the lateral direction (X1, X2), respectively. Second steps 89*a* and 89*b* are provided between the second locking portion 83 and the second arms 84*a* and 84*b*. The second arms 84*a* and 84*b* include second corners 90*a* and 90*b*. The second corners 90*a* and 90*b* are rounded. As illustrated in FIG. 8, the second surface 86 includes a surface 86*a* located between the second arms 84*a* and 84*b*, a surface 86*b* located in the first lateral direction (X1) of the second arms 84*a*, and a surface 86*c* located in the second lateral direction (X2) of the second arm 84*b*. The surface 86*a* is located at the same height as the surfaces 86*b* and 86*c* in the support direction (Z1, Z2). As a result, the flexibility of the second arms 84*a* and 84*b* is improved.

As illustrated in FIG. 10, a thickness A1 of the first arms 82*a* and 82*b* in the support direction (Z1, Z2) is smaller than a thickness A2 of the first locking portion 81 in the support direction (Z1, Z2). A radius R1 of the roundness of the first corners 88*a* and 88*b* is larger than the thickness A1 of the first arms 82*a* and 82*b* in the support direction (Z1 and Z2). A thickness A3 of the second arms 84*a* and 84*b* in the support direction (Z1, Z2) is smaller than a thickness A4 of the second locking portion 83 in the support direction (Z1, Z2). A radius R2 of the roundness of the second corners 90*a* and 90*b* is larger than the thickness A3 of the second arms 84*a* and 84*b* in the support direction (Z1, Z2).

The first locking portion 81 locks to the first protrusion 41 in the moving direction. Specifically, the first locking portion 81 locks to the first locking surface 410 of the first protrusion 41 in the moving direction (Y1, Y2). The second locking portion 83 locks to the second protrusion 42 in the moving direction (Y1, Y2). Specifically, the second locking portion 83 locks to the second locking surface 420 of the second protrusion 42 in the moving direction (Y1, Y2). That is, the locking direction by snap fitting coincides with the moving direction (Y1, Y2) of the moving member 17.

As illustrated in FIG. 4, the contact block 2 includes a first contact spring 51 and a second contact spring 52. The first contact spring 51 is disposed between the first movable contact piece 15 and the support portion 25. The first contact spring 51 is disposed in the first support hole 28. In a state where the first movable contact 31 is in contact with the first fixed contact 21 and the second movable contact 32 is in contact with the second fixed contact 22, the first contact spring 51 presses the first movable contact piece 15 toward the first fixed terminal 13 and the second fixed terminal 14. The first contact spring 51 is a coil spring, and is in a state of natural length when the moving member 17 is located in the open position. The first movable contact piece 15 is connected to the moving member 17 via the first contact spring 51.

The second contact spring 52 is disposed between the second movable contact piece 16 and the support portion 25. The second contact spring 52 is disposed in the second support hole 29. In a state where the third movable contact 33 is in contact with the third fixed contact 23 and the fourth movable contact 34 is in contact with the fourth fixed contact 24, the second contact spring 52 presses the second movable contact piece 16 toward the first fixed terminal 13 and the second fixed terminal 14. The second contact spring 52 is a coil spring, and is in a state of natural length when the moving member 17 is located in the open position. The second movable contact piece 16 is connected to the moving member 17 via the second contact spring 52.

The connecting portion 26 extends in the lateral direction (X1, X2). As illustrated in FIG. 7, the connecting portion 26 includes a core connector 37, a first mount 38, and a second mount 39. The core connector 37 is located between the first mount 38 and the second mount 39. The core connector 37 is connected to the link portion 27. As illustrated in FIGS. 4 and 7, the core connector 37 includes a hole 43 and a locking groove 44. The hole 43 extends in the support direction (Z1, Z2). The hole 43 is opened toward the first support direction (Z1). The locking groove 44 communicates with the hole 43 and extends in the second support direction (Z2). A width of the locking groove 44 is narrower than a width of the hole 43.

The movable iron core 63 includes a tubular portion 71, a protruding portion 72, a shaft portion 77, and a head 78. The protruding portion 72 protrudes from the tubular portion 71 toward the fixed iron core 64. An outer diameter of the protruding portion 72 is smaller than an outer diameter of the tubular portion 71. The protruding portion 72 has a tapered shape toward the fixed iron core 64. The shaft portion 77 projects from the tubular portion 71 toward the moving member 17. An outer diameter of the shaft portion 77 is smaller than the outer diameter of the tubular portion 71. An outer diameter of the head 78 is larger than the outer diameter of the shaft portion 77. The outer diameter of the head 78 is larger than a width of the locking groove 44. The shaft portion 77 is disposed in the locking groove 44. The head 78 is disposed in the hole 43.

Figure 12:
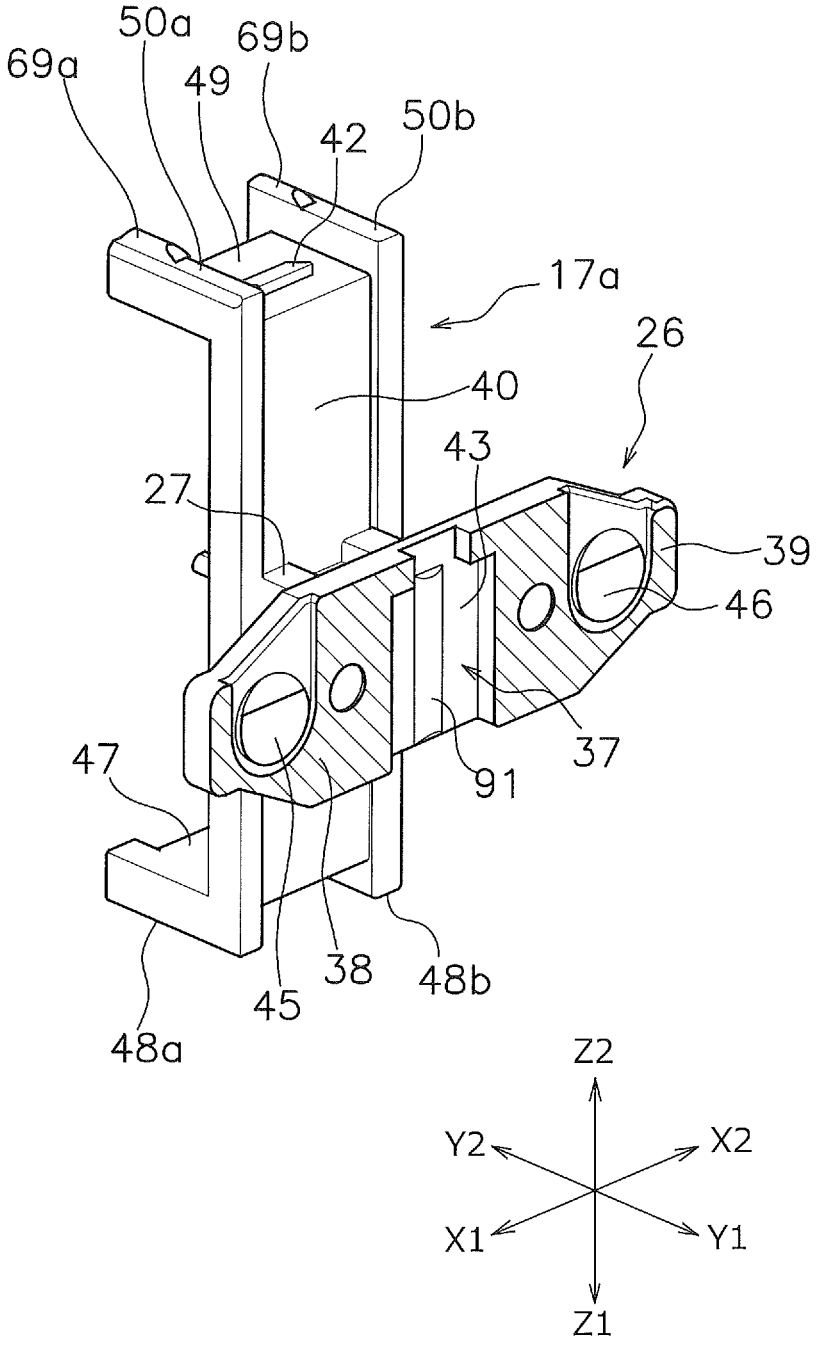
FIG. 12 is a partial cross-sectional view of a first member.
Figure 13:
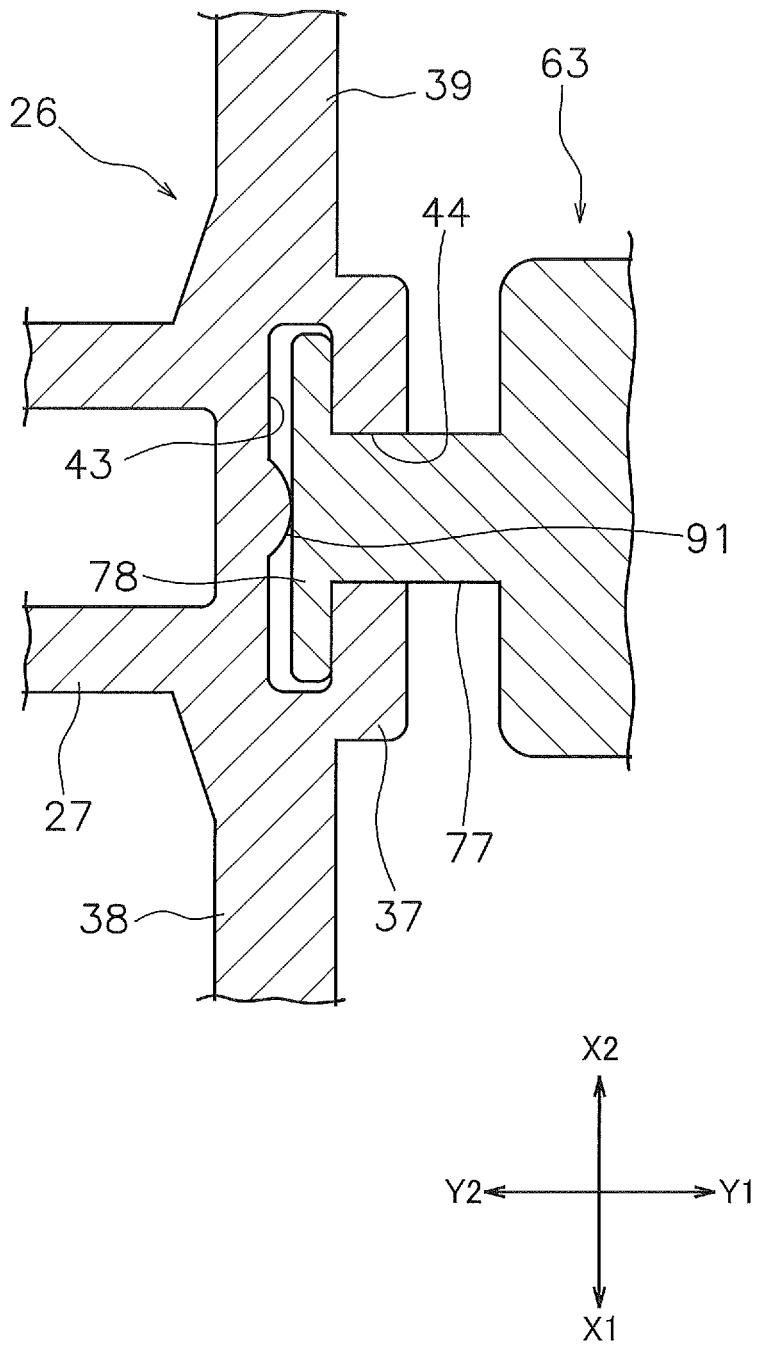
FIG. 13 is a cross-sectional view of the first member and a movable iron core.

FIG. 12 is a partial cross-sectional view of the first member 17*a*. FIG. 13 is a cross-sectional view taken along the line XIII-XIII of the first member 17*a* and the movable iron core in FIG. 4. As illustrated in FIGS. 12 and 13, a locking projection 91 is provided on an inner surface of the hole 43. The locking projection 91 projects from the inner surface of the hole 43 in the first moving direction (Y1). The locking projection 91 has a shape extending in the support direction (Z1, Z2). As illustrated in FIG. 4, the locking projection 91 is longer than the locking groove 44 in the support direction (Z1, Z2). In the support direction (Z1, Z2), the locking projection 91 is longer than the head 78 of the movable iron core 63. The locking projection 91 has a curved shape in a cross section perpendicular to the support direction (Z1, Z2). The locking projection 91 presses the head 78 of the movable iron core 63 in the locking groove 44. As a result, the head 78 of the movable iron core 63 is fixed to the connecting portion 26 by press fitting.

As illustrated in FIG. 7, the first mount 38 extends from the core connector 37 in the first lateral direction (X1). The first mount 38 includes a first protrusion 45. The first protrusion 45 projects from the first mount 38 toward the coil block 4. The second mount 39 extends from the core connector 37 in the second lateral direction (X2). The second mount 39 includes a second protrusion 46. The second protrusion 46 projects from the second mount 39 toward the coil block 4.

The electromagnetic relay 1 includes a first return spring 53 and a second return spring 54. The first return spring 53 and the second return spring 54 are disposed between the moving member 17 and the coil block 4. The first return spring 53 is located in the first lateral direction (X1) with respect to the core connector 37. The second return spring 54 is located in the second lateral direction (X2) with respect to the core connector 37. In other words, the core connector 37 is located between the first return spring 53 and the second return spring 54 in the lateral direction (X1, X2). The first return spring 53 and the second return spring 54 urge the moving member 17 in the second moving direction (Y2). The first return spring 53 is attached to the first protrusion 45. The second return spring 54 is attached to the second protrusion 46.

Figure 14:
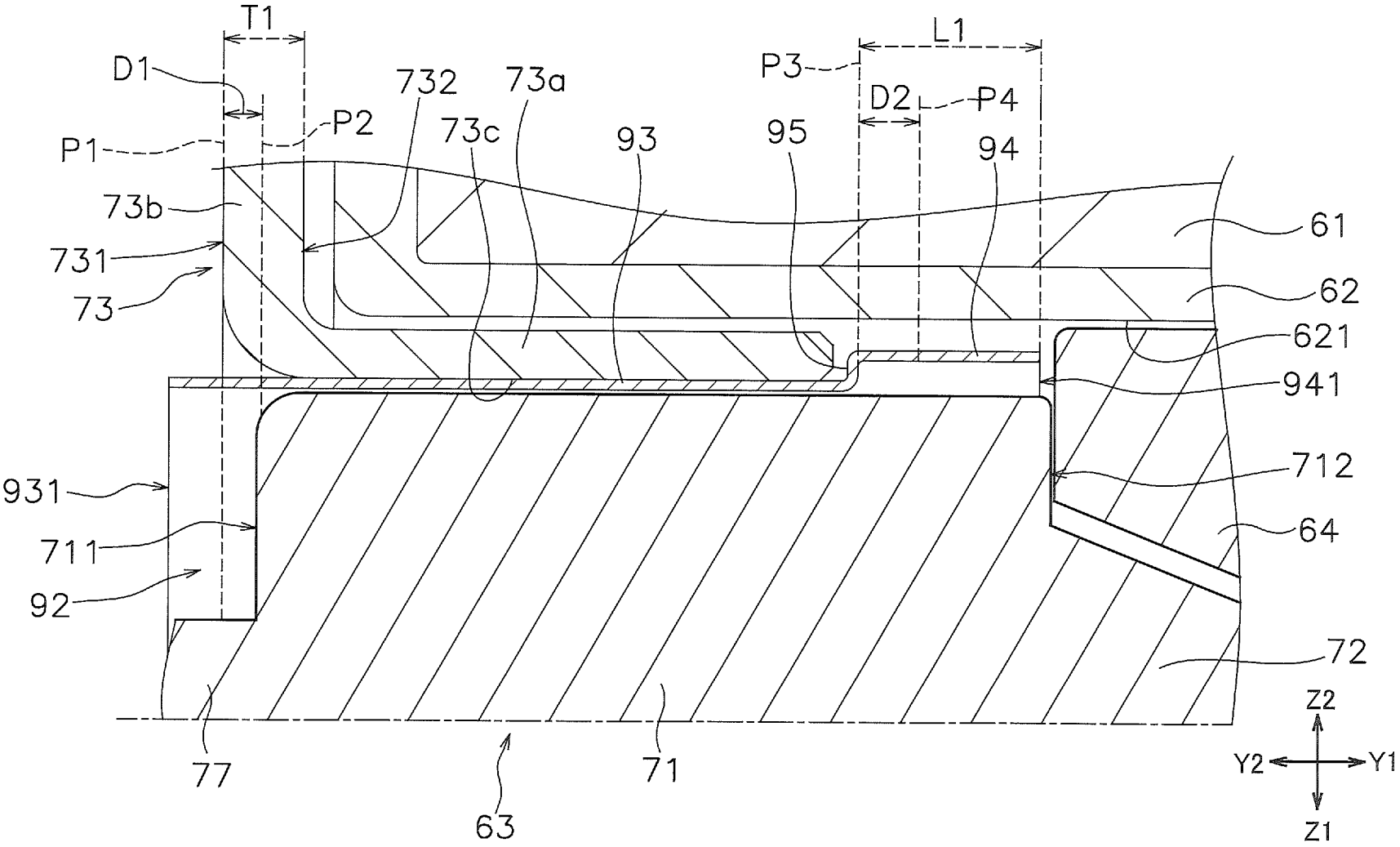
FIG. 14 is a diagram showing a position of the movable iron core when the moving member is located at the closed position.

FIG. 14 is an enlarged view showing the configuration of the movable iron core 63 and its surroundings. As illustrated in FIG. 14, the electromagnetic relay 1 includes a guide member 92. The guide member 92 is fixed to the first yoke 73. For example, a fluorine-based lubricant is applied to the inner surface of the guide member 92. The guide member 92 is made of a non-magnetic material such as stainless steel, brass, or copper. The guide member 92 is disposed in the spool hole 621. The guide member 92 includes a first guide portion 93, a second guide portion 94, and a step 95.

The first guide portion 93 has a circular tubular shape. The first guide portion 93 extends in the moving direction (Y1, Y2). The first guide portion 93 is disposed in the yoke hole 73*c*. The first guide portion 93 may protrude from the first surface 731 toward the moving member 17. In that case, when assembling the electromagnetic relay 1, it can be easily detected that the guide member 92 is securely assembled. The first guide portion 93 includes the first guide end 931. The first guide end 931 is an end of the guide member 92 in the second moving direction (Y2). The first guide end 931 faces the moving member 17 in the moving direction (Y1, Y2). The first guide end 931 is located outside the yoke hole 73*c*.

The second guide portion 94 has a circular tubular shape. The second guide portion 94 extends in the moving direction (Y1, Y2). The second guide portion 94 is disposed in the spool hole 621. The second guide portion 94 is located outside the yoke hole 73*c*. The second guide portion 94 has an inner diameter larger than an inner diameter of the first guide portion 93. The inner diameter of the second guide portion 94 is larger than the diameter of the yoke hole 73*c*. An outer diameter of the second guide portion 94 is smaller than an outer diameter of the pipe portion 73*a*. The second guide portion 94 is disposed between the pipe portion 73*a* and the fixed iron core 64. The second guide portion 94 includes the second guide end 941. The second guide end 941 is an end of the guide member 92 in the first moving direction (Y1). The second guide end 941 faces the fixed iron core 64 in the moving direction (Y1, Y2). The step 95 is disposed between the first guide portion 93 and the second guide portion 94. The step 95 extends in the radial direction of the guide member 92. The step 95 is connected to the first guide portion 93 and the second guide portion 94.

The tubular portion 71 of the movable iron core 63 is disposed in the guide member 92. The tubular portion 71 includes a first end surface 711 and a second end surface 712 in the moving direction (Y1, Y2). The first end surface 711 is the end surface of the tubular portion 71 in the second moving direction (Y2). The first end surface 711 faces the moving member 17 in the moving direction (Y1, Y2). The second end surface 712 is located opposite to the first end surface 711 in the moving direction (Y1, Y2). The second end surface 712 is the end surface of the tubular portion 71 in the first moving direction (Y1). The second end surface 712 faces the fixed iron core 64 in the moving direction (Y1, Y2).

Next, the operation of the electromagnetic relay 1 will be described. When the coil 61 is not energized, the coil block 4 is not excited. In this case, the moving member 17 is pressed in the second moving direction (Y2) by the elastic force of the return springs 53 and 54 together with the movable iron core 63, and the moving member 17 is located at the open position illustrated in FIG. 5. In this state, the first movable contact piece 15 and the second movable contact piece 16 are also pressed in the second moving direction (Y2) via the moving member 17. Therefore, when the moving member 17 is located at the open position, the first movable contact 31 and the second movable contact 32 are separated from the first fixed contact 21 and the second fixed contact 22. Similarly, when the moving member 17 is located at the open position, the third movable contact 33 and the fourth movable contact 34 are separated from the third fixed contact 23 and the fourth fixed contact 24.

When the coil 61 is energized, the coil block 4 is magnetized. In this case, due to the electromagnetic force of the coil 61, the movable iron core 63 moves in the first moving direction (Y1) against the elastic force of the return springs 53 and 54. As a result, the moving member 17, the first movable contact piece 15, and the second movable contact piece 16 move in the first moving direction (Y1). Therefore, as illustrated in FIG. 6, the moving member 17 moves to the closed position. As a result, when the moving member 17 is located in the closed position, the first movable contact 31 and the second movable contact 32 contact the first fixed contact 21 and the second fixed contact 22, respectively. Similarly, when the moving member 17 is located in the closed position, the third movable contact 33 and the fourth movable contact 34 contact the third fixed contact 23 and the fourth fixed contact 24, respectively. As a result, the first movable contact piece 15 and the second movable contact piece 16 are electrically connected to the first fixed terminal 13 and the second fixed terminal 14.

When the current to the coil 61 is stopped and degaussed, the movable iron core 63 is pressed in the second moving direction (Y2) by the elastic force of the return springs 53 and 54. As a result, the moving member 17, the first movable contact piece 15, and the second movable contact piece 16 move in the second moving direction (Y2). Therefore, as illustrated in FIG. 5, the moving member 17 moves to the open position. As a result, when the moving member 17 is located at the open position, the first movable contact 31 and the second movable contact 32 are separated from the first fixed contact 21 and the second fixed contact 22. Similarly, when the moving member 17 is located in the open position, the third movable contact 33 and the fourth movable contact 34 are separated from the third fixed contact 23 and the fourth fixed contact 24.

Figure 15:
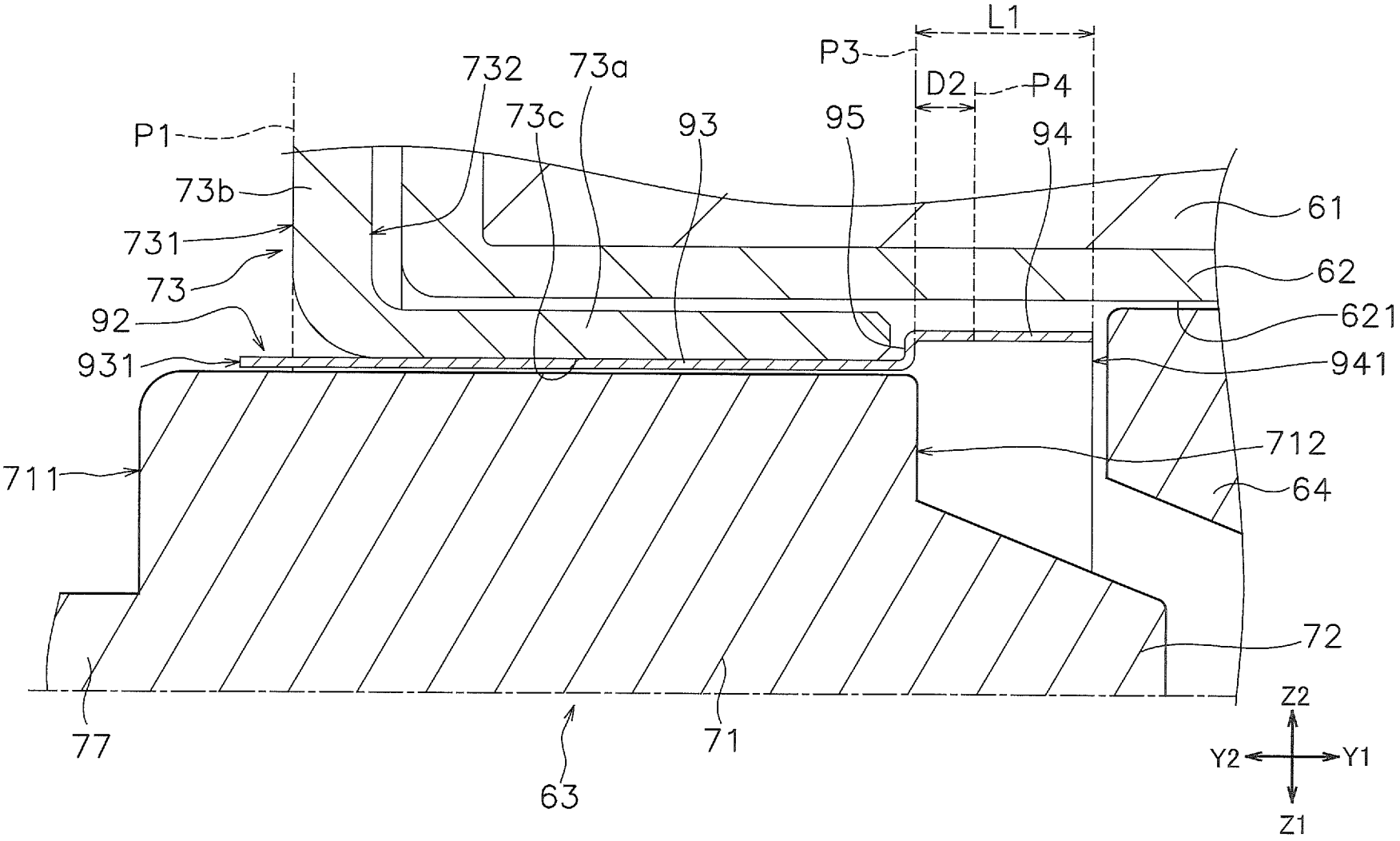
FIG. 15 is a diagram showing a position of the movable iron core when the moving member is in the open position.

FIG. 14 shows a position of the movable iron core 63 when the moving member 17 is located at the closed position. FIG. 15 shows a position of the movable iron core 63 when the moving member 17 is located at the open position. In FIGS. 14 and 15, the first to fourth positions P1 to P4 are defined as follows. The first position P1 is a position corresponding to the first surface 731. The second position P2 is located at the center of the first surface 731 and the second surface 732 in the moving direction (Y1, Y2). The second position P2 is a position apart from the first surface 731 by a first distance D1 in the first moving direction (Y1). The first distance D1 is half the thickness T1 of the plate portion 73*b* in the moving direction (Y1, Y2). The third position P3 is a position corresponding to the inner surface of the step 95. The fourth position P4 is a position in the second guide portion 94 that is apart from the third position P3 by a second distance D2 in the first movement direction (Y1). The second distance D2 is one-third of the length L1 of the second guide portion 94 in the moving direction (Y1, Y2).

As illustrated in FIG. 14, in a case where the moving member 17 is located at the closed position, a part of the tubular portion 71 is located in the second guide portion 94. In a case where the moving member 17 is located at the closed position, the first end surface 711 is located in the first guide portion 93. In a case where the moving member 17 is located at the closed position, the first end surface 711 exceeds the first position P1 in the first moving direction (Y1). In a case where the moving member 17 is located at the closed position, the first end surface 711 is located within the range from the first position P1 to the second position P2. In a case where the moving member 17 is located at the closed position, the second end surface 712 exceeds the fourth position P4 in the first moving direction (Y1).

As illustrated in FIG. 15, in a case where the moving member 17 is located at the open position, the first end surface 711 is located outside the yoke hole 73*c*. In a case where the moving member 17 is located at the open position, the first end surface 711 exceeds the first position P1 in the second moving direction (Y2). In a case where the moving member 17 is located at the open position, the first end surface 711 is located outside the guide member 92. In a case where the moving member 17 is located at the open position, the second end surface 712 is located within the range from the third position P3 to the fourth position P4.

In the electromagnetic relay 1 according to the present embodiment described above, the first movable contact piece 15 is connected to the movable iron core 63 via the moving member 17. The moving member 17 is made of a resin having electrical insulation and is directly connected to the movable iron core 63. Therefore, a large insulation distance between the first movable contact piece 15 and the movable iron core 63 is provided.

In a case where the moving member 17 is located at the closed position, the first end surface 711 of the movable iron core 63 is located within the range from the first position P1 to the second position P2. Therefore, the inclination of the movable iron core 63 is suppressed when the moving member 17 is located at the closed position. As a result, the behavior of the first movable contact piece 15 is stabilized, and thereby the operation of the electromagnetic relay 1 is stabilized. Further, the magnetic efficiency of the yoke 65 and the movable iron core 63 is improved. Further, in a case where the moving member 17 is located at the open position, the second end surface 712 is located within the range from the third position P3 to the fourth position P4. Therefore, the inclination of the movable iron core 63 is suppressed when the moving member 17 is located at the open position.

Although one embodiment of the present invention has been described above, the present invention is not limited to the above embodiment, and various modifications can be made without departing from the gist of the invention.

In the above embodiment, the coil block 4 pushes the moving member 17 in the second moving direction (Y2), so that the movable contacts 31 to 34 are separated from the fixed contacts 21 to 24. Further, the coil block 4 pulls the moving member 17 in the first moving direction (Y1), so that the movable contacts 31 to 34 contact the fixed contacts 21 to 24. However, the operating direction of the moving member 17 for opening and closing the contacts may be opposite to that of the above embodiment. That is, the coil block 4 may push the moving member 17 in the second moving direction (Y2) so that the movable contacts 31 to 34 may contact the fixed contacts 21 to 24. The coil block 4 may pull the moving member 17 in the first moving direction (Y1) so that the movable contacts 31 to 34 may be separated from the fixed contacts 21 to 24.

The shapes or arrangements of the first fixed terminal 13, the second fixed terminal 14, the first movable contact piece 15, and the second movable contact piece 16 may be changed. For example, the first fixed terminal 13 and the second fixed terminal 14 may protrude from the base 11 in a direction different from that of the above embodiment. The first movable contact piece 15 and the second movable contact piece 16 may be integrated with each other. That is, the first to fourth movable contacts 31 to 34 may be connected to the integrated movable contact piece. Alternatively, the second movable contact piece 16, the third and fourth movable contacts 33 and 34, and the third and fourth fixed contacts 23 and 24 may be omitted.

The shapes or arrangements of the coil 61, the spool 62, the movable iron core 63, the fixed iron core 64, or the yoke 65 may be changed. The shapes or arrangements of the first to fourth fixed contacts 21 to 24 may be changed. The shapes or arrangements of the first to fourth movable contacts 31 to 34 may be changed. The shape of the base 11 may be changed.

The first fixed contact 21 and/or the third fixed contact 23 may be integrated with the first fixed terminal 13. The first fixed contact 21 and/or the third fixed contact 23 may be a part of the first fixed terminal 13 and may be flush with other part of the first fixed terminal 13. The second fixed contact 22 and/or the fourth fixed contact 24 may be integrated with the second fixed terminal 14. The second fixed contact 22 and/or the fourth fixed contact 24 may be a part of the second fixed terminal 14 and may be flush with other part of the second fixed terminal 14.

The first movable contact 31 and/or the second movable contact 32 may be integrated with the first movable contact piece 15. The first movable contact 31 and/or the second movable contact 32 may be a part of the first movable contact piece 15 and may be flush with other part of the first movable contact piece 15. The third movable contact 33 and/or the fourth movable contact 34 may be integrated with the second movable contact piece 16. The third movable contact 33 and/or the fourth movable contact 34 may be a part of the second movable contact piece 16 and may be flush with other part of the second movable contact piece 16.

The shape of the moving member 17 is not limited to that of the above embodiment, and may be changed. The shape of the first member 17*a* may be changed. For example, the first member 17*a* may be a separate body from the link portion 27 and the connecting portion 26. The shape of the second member 17*b* may be changed. The shape of the link portion 27 may be changed. The shape of the connecting portion 26 may be changed.

The position of the movable iron core 63 in a case where the moving member 17 is located at the closed position is not limited to that of the above embodiment, and may be changed. The first end surface 711 may be located at the first position P1 in a case where the moving member 17 is located at the closed position. The first end surface 711 may be located at the second position P2 in a case where the moving member 17 is located at the closed position. The position of the movable iron core 63 in a case where the moving member 17 is located at the open position is not limited to that of the above embodiment, and may be changed. The second end surface 712 may be located at the third position P3 in a case where the moving member 17 is located at the open position. The second end surface 712 may be located at the fourth position P4 in a case where the moving member 17 is located at the open position.

REFERENCE SIGNS LIST

3: Housing, 13: First fixed terminal, 14: Second fixed terminal, 15: First movable contact piece, 16: Second movable contact piece, 17: Moving member, 21: First fixed contact, 22: Second fixed contact, 23: Third fixed contact, 24: Fourth fixed contact, 25: Support portion, 26: Connecting portion, 27: Link portion, 31: First movable contact, 32: Second movable contact, 33: Third movable contact, 34: Fourth movable contact, 61: Coil, 62: Spool, 63: Movable iron core 63, 71: Tubular portion, 73: First yoke, 73*a*: Pipe portion, 73*b*: Plate portion, 77: Shaft portion, 92: Guide member, 93: first guide portion, 94: second guide portion, 95: Step, 621: Spool hole, 711: First end surface, 712: Second end surface, 731: First surface, 732: Second surface, P1: First position, P2: Second position, P3: Third position, P4: Fourth position

The invention claimed is:

1. An electromagnetic relay comprising:
- a first fixed terminal;
- a first fixed contact connected to the first fixed terminal;
- a second fixed terminal;
- a second fixed contact connected to the second fixed terminal;
- a first movable contact piece;
- a first movable contact that faces the first fixed contact, the first movable contact being connected to the first movable contact piece;
- a second movable contact that faces the second fixed contact, the second movable contact being connected to the first movable contact piece;
- a moving member that holds the first movable contact piece, the moving member being made of a resin having electrical insulation, the moving member being configured to move between a closed position and an open position in a moving direction, the closed position being a position in which the first movable contact and the second movable contact come into contact with the first fixed contact and the second fixed contact respectively, the open position being a position in which the first movable contact and the second movable contact are separated from the first fixed contact the second fixed contact respectively;
- a housing that slidably supports the moving member in a support direction perpendicular to the moving direction;
- a spool including a spool hole extending in the moving direction;
- a coil wound around the spool;
- a yoke including
  - a pipe portion disposed in the spool hole,
  - a plate portion extending from the pipe portion in the support direction and a lateral direction perpendicular to the support direction and the movement direction, and
  - a yoke hole extending in the moving direction through the pipe portion and the plate portion;
- a guide member disposed in the yoke hole, the guide member including
  - a first guide portion disposed in the yoke hole,
  - a second guide portion having an inner diameter larger than an inner diameter of the first guide portion, and
  - a step disposed between the first guide portion and the second guide portion; and
- a movable iron core connected to the moving member, the movable iron core being configured to move in the moving direction by a magnetic force generated by the coil, the movable iron core including
  - a tubular portion disposed in the guide member, the tubular portion including a first end surface and a second end surface in the moving direction, and a shaft portion protruding from the first end surface toward the moving member, wherein the plate portion includes a first surface that faces the moving member, and a second surface that faces the spool, the second surface being located opposite the first surface, in a case where the moving member is located at the closed position, a part of the tubular portion is located in the second guide portion, and in the case where the moving member is located at the closed position, the first end surface is located in a range from a first position to a second position, the first position being a position corresponding to the first surface, the second position being located at a center of the first surface and the second surface in the moving direction.

2. The electromagnetic relay according to claim 1, wherein in the case where the moving member is located at the closed position, the first end surface is located in the first guide portion.

3. The electromagnetic relay according to claim 1, wherein in a case where the moving member is in the open position, the first end surface is located outside the guide member, the second end surface is located in a range from a third position to a fourth position, the third position is a position corresponding to the step, the fourth position is a position that is apart from the third position by a predetermined distance in the movement direction in the second guide portion, and the predetermined distance is one-third of a length of the second guide portion in the moving direction.

4. The electromagnetic relay according to claim 1, wherein the first guide portion protrudes from the first surface toward the moving member.

5. The electromagnetic relay according to claim 1, wherein the guide member is made of a non-magnetic material.

6. The electromagnetic relay according to claim 1, wherein the moving member includes a support portion that supports the first movable contact piece, a connecting portion connected to the movable iron core, and a link portion that connects the support portion and the connecting portion, the link portion extending in the moving direction.

7. The electromagnetic relay according to claim 6, wherein the support portion extends in the support direction, and the link portion is connected to a central portion of the support portion in the support direction.

8. The electromagnetic relay according to claim 6, further comprising:

a third fixed contact connected to the first fixed terminal;

a fourth fixed contact connected to the second fixed terminal;

a second movable contact piece;

a third movable contact that faces the third fixed contact, the third movable contact being connected to the second movable contact piece; and a fourth movable contact that faces the fourth fixed contact, the fourth movable contact being connected to the second movable contact piece, wherein the support portion supports the second movable contact piece, and the link portion is connected to the support portion at a position between the first movable contact piece and the second movable contact piece in the support direction.

9. The electromagnetic relay according to claim 6, wherein the support portion includes a first slider that protrudes in the support direction, the first slider being slidable with respect to the housing.

10. The electromagnetic relay according to claim 9, wherein the support portion further includes a second slider that protrudes in a direction opposite to the support direction, the second slider being slidable with respect to the housing.

* * * * *